US010068541B2

(12) United States Patent
Sakaigawa

(10) Patent No.: US 10,068,541 B2
(45) Date of Patent: Sep. 4, 2018

(54) DISPLAY DEVICE

(71) Applicant: Japan Display Inc., Tokyo (JP)

(72) Inventor: Akira Sakaigawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 254 days.

(21) Appl. No.: 15/055,652

(22) Filed: Feb. 29, 2016

(65) Prior Publication Data

US 2016/0260401 A1 Sep. 8, 2016

(30) Foreign Application Priority Data

Mar. 5, 2015 (JP) ..... 2015-043929

(51) Int. Cl.
*G09G 3/36* (2006.01)
*G09G 3/20* (2006.01)

(52) U.S. Cl.
CPC ..... *G09G 3/3648* (2013.01); *G09G 3/3607* (2013.01); *G09G 3/2003* (2013.01); *G09G 3/2074* (2013.01); *G09G 2300/0426* (2013.01); *G09G 2300/0452* (2013.01); *G09G 2300/0465* (2013.01); *G09G 2310/08* (2013.01); *G09G 2320/0626* (2013.01)

(58) Field of Classification Search
CPC .. G09G 3/3648; G09G 3/3607; G09G 3/2003; G09G 3/2074; G09G 2300/0426; G09G 2300/0452; G09G 2300/0465
See application file for complete search history.

(56) References Cited

U.S. PATENT DOCUMENTS

| | | | | |
|---|---|---|---|---|
| 8,432,412 | B2 | 4/2013 | Sakaigawa | |
| 8,624,943 | B2 | 1/2014 | Noguchi et al. | |
| 2001/0019382 | A1* | 9/2001 | Song | G09G 3/3607 349/106 |
| 2005/0168423 | A1* | 8/2005 | Hirata | G09G 3/2003 345/88 |
| 2008/0084376 | A1* | 4/2008 | Hirota | G09G 3/3607 345/88 |

(Continued)

FOREIGN PATENT DOCUMENTS

| | | | |
|---|---|---|---|
| JP | 2011-154323 | A | 8/2011 |
| KR | 10-2006-0082104 | A | 7/2006 |
| KR | 10-2008-0032618 | A | 4/2008 |

OTHER PUBLICATIONS

Korean Office Action dated Feb. 19, 2017 for corresponding Korean Application No. 10-2016-0025913.

*Primary Examiner* — Ariel Balaoing
(74) *Attorney, Agent, or Firm* — Michael Best & Friedrich LLP

(57) ABSTRACT

According to an aspect, a display device comprising a display unit that produces a display output corresponding to an input signal. The display unit combines the display output corresponding to each of four or more colors. The display unit includes a plurality of pixels each including three or more sub-pixels, the number of which is smaller than the number of colors. The pixel includes, as the sub-pixels, one first sub-pixel having largest display region among the sub-pixels and two or more second sub-pixels each having a display region smaller than that of the first sub-pixel. One of the second sub-pixels outputs a high luminance color having highest luminance among the four or more colors.

20 Claims, 27 Drawing Sheets

(56) References Cited

U.S. PATENT DOCUMENTS

| | | | | |
|---|---|---|---|---|
| 2009/0167779 | A1* | 7/2009 | Inuzuka | G09G 3/2003 345/589 |
| 2011/0181635 | A1 | 7/2011 | Kabe et al. | |
| 2011/0291550 | A1 | 12/2011 | Kim et al. | |
| 2016/0275858 | A1* | 9/2016 | Wang | H01L 27/32 |

* cited by examiner

FIG.13

| BEFORE SIGNAL CONTROL PROCESSING | | AFTER SIGNAL CONTROL PROCESSING | |
|---|---|---|---|
| FIRST ROW | R(1,1)B(1,1)W(1,1)<br>G(1,2)B(1,2)W(1,2)<br>R(1,3)G(1,3)W(1,3)<br>… | Gp+1 | R(1,1)B(1,1)<br>G(1,2)B(1,2)<br>R(1,3)G(1,3)<br>… |
| SECOND ROW | R(2,1)G(2,1)W(2,1)<br>R(2,2)B(2,2)W(2,2)<br>G(2,3)B(2,3)W(2,3)<br>… | Gp+2 | W(1,1)W(1,2)W(1,3)<br>R(2,1)G(2,1)<br>R(2,2)B(2,2)<br>G(2,3)B(2,3)<br>… |
| THIRD ROW | G(3,1)B(3,1)W(3,1)<br>R(3,2)G(3,2)W(3,2)<br>R(3,3)B(3,3)W(3,3)<br>… | Gp+3 | W(2,1)W(2,2)W(2,3)<br>R(2,1)G(2,1)<br>R(2,2)B(2,2)<br>G(2,3)B(2,3)<br>… |
| ⋮ | ⋮ | ⋮ | ⋮ |

DISPLAY DEVICE

CROSS-REFERENCE TO RELATED APPLICATIONS

This application claims priority from Japanese Application No. 2015-043929, filed on Mar. 5, 2015, the contents of which are incorporated by reference herein in its entirety.

BACKGROUND

1. Technical Field

The present invention relates to a display device.

2. Description of the Related Art

In recent years, demands for display devices for a mobile apparatus such as a cellular telephone and electronic paper have been growing. In the display devices, one pixel includes a plurality of sub-pixels, the sub-pixels output colors different from each other, and display of each sub-pixel is turned on and off so that various colors are displayed by one pixel. In such display devices, display characteristics such as resolution and luminance have been improved year by year. However, as the resolution is increased, an aperture ratio is reduced. Thus, luminance of a backlight needs to be increased to achieve high luminance, so that power consumption of the backlight is disadvantageously increased. To solve this problem, for example, Japanese Patent Application Laid-open Publication No. 2011-154323 (JP-A-2011-154323) discloses a technique of producing a display output with four colors including white (W) in addition to primary colors such as red (R), green (G), and blue (B) in the related art to secure the luminance. In this technique, a sub-pixel of white (W) improves the luminance and reduces a current value of the backlight accordingly, which reduces the power consumption. When the current value of the backlight is not reduced, the luminance is improved by the white pixel, so that visibility under external light outside can be improved by utilizing the improved luminance.

JP-A-2011-154323 discloses an image display panel in which pixels each including sub-pixels of red (R), green (G), blue (B), and white (W) are arranged in a two-dimensional matrix. FIGS. 2, 22, and 23 in JP-A-2011-154323 illustrate arrays of sub-pixels of red (R), green (G), blue (B), and white (W). However, with the array to which the sub-pixel of white (W) is simply added such as the array disclosed in JP-A-2011-154323, the aperture ratio may be reduced as the sub-pixels constituting one pixel are increased, and the aperture ratio tends to be significantly reduced due to the increase in the number of sub-pixels as the resolution is increased.

For the foregoing reasons, there is a need for a display device that includes a display unit for producing a display output using four or more colors, and can further increase the aperture ratio.

SUMMARY

According to an aspect, a display device comprising a display unit that produces a display output corresponding to an input signal. The display device combines the display output corresponding to each of four or more colors. The display unit includes a plurality of pixels each including three or more sub-pixels, the number of which is smaller than the number of colors. The pixel includes, as the sub-pixels, one first sub-pixel having largest display region among the sub-pixels and two or more second sub-pixels each having a display region smaller than that of the first sub-pixel. One of the second sub-pixels outputs a high luminance color having highest luminance among the four or more colors.

According to another aspect, a display device comprising a display unit including a color filter provided such that light of four or more predetermined number of colors is obtained. The display unit includes a plurality of partial regions. The partial regions each include a first display region that is largest and two or more second display regions each of which is smaller than the first display region. Color filters corresponding to three or more colors the number of which is smaller than the predetermined number are arranged in each partial region. A color having the highest luminance among the predetermined number of colors is assigned to one of the second display regions.

BRIEF DESCRIPTION OF THE DRAWINGS

FIG. 13 is a diagram illustrating an example of a relation between output signals for the sub-pixels included in each of the pixels after the sub-pixel rendering processing and output signals output through signal control processing in accordance with a timing for driving a scanning line;

DETAILED DESCRIPTION

Figure 1:
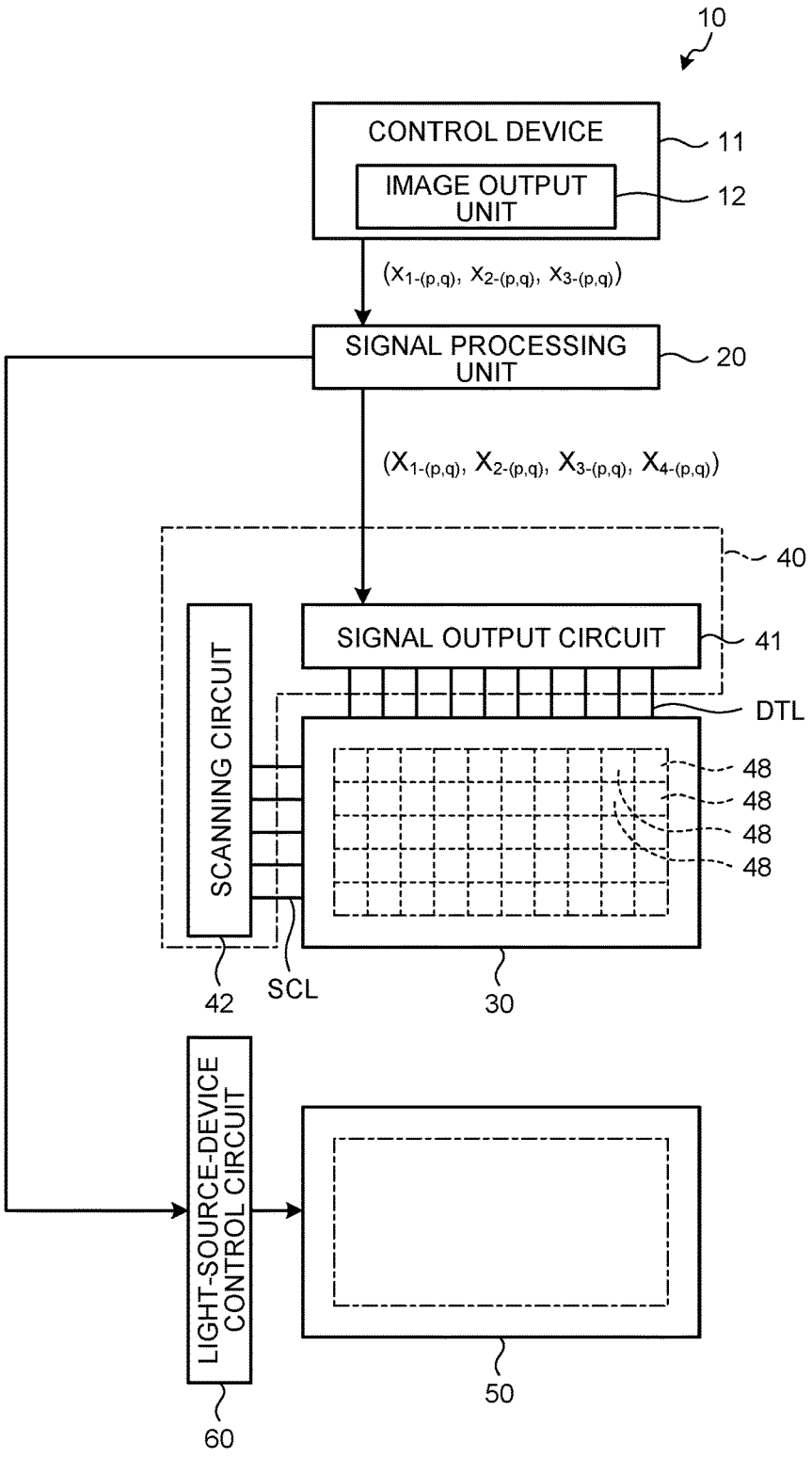
FIG. 1 is a block diagram illustrating a configuration example of a display device according to an embodiment.

The following describes an embodiment in detail with reference to the drawings. The present invention is not limited to the embodiment described below. Components described below include a component that is easily conceivable by those skilled in the art and substantially the same component. The components described below can be appropriately combined. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

Figure 2:
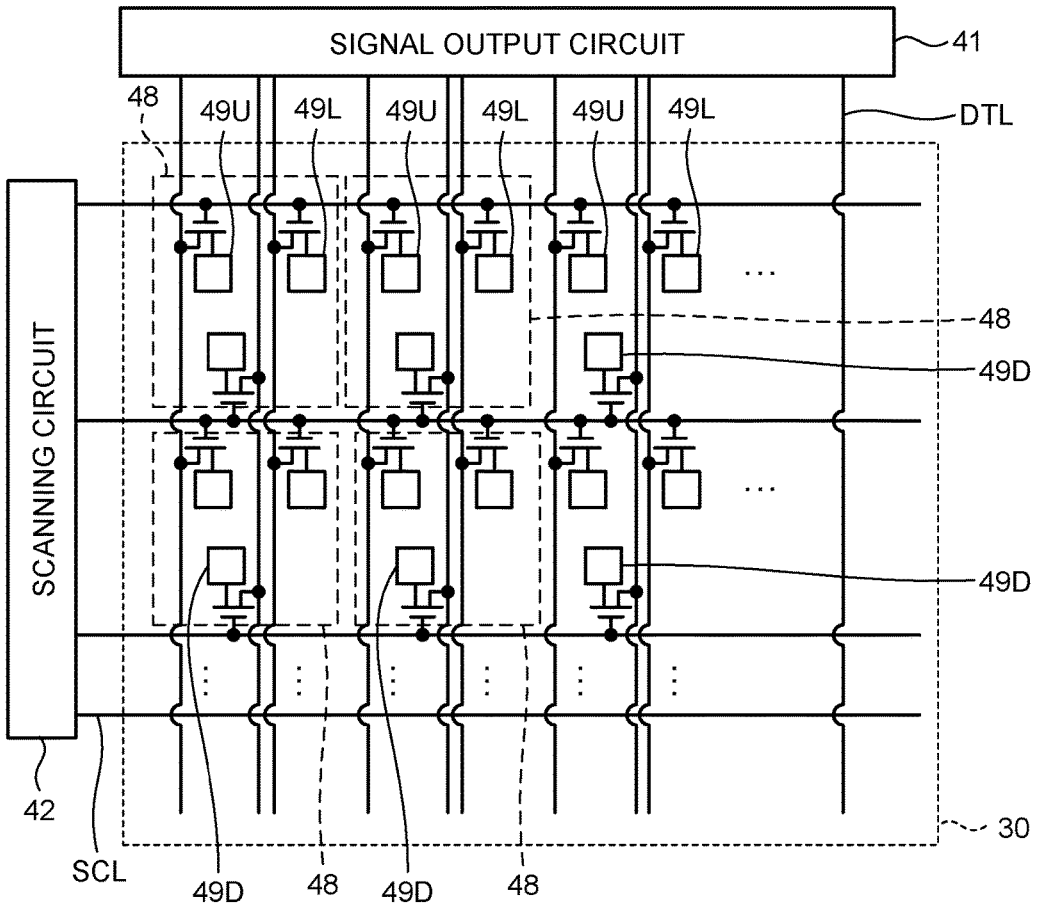
FIG. 2 is a conceptual diagram of an image display panel and an image-display-panel drive circuit of the display device.
Figure 3:
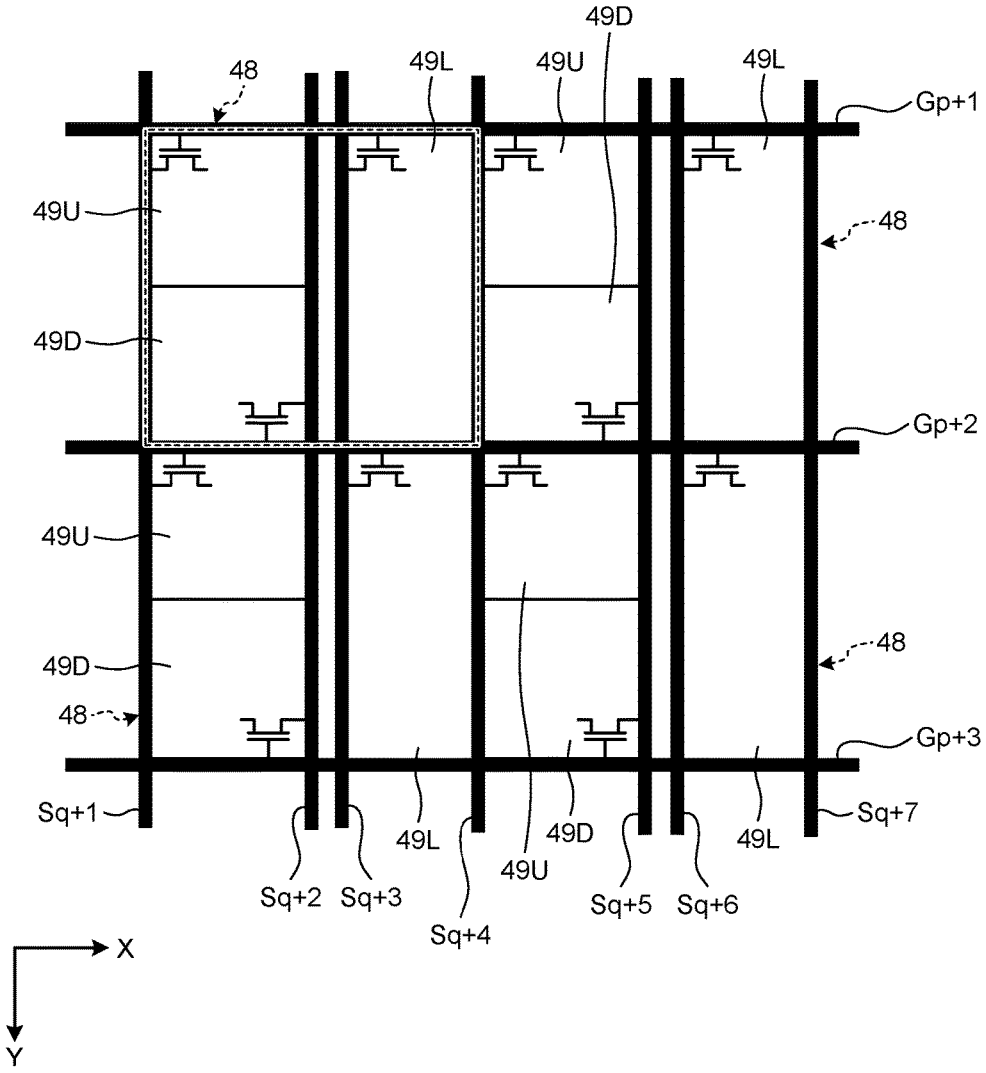
FIG. 3 is an explanatory diagram illustrating an array of pixels and sub-pixels in the image display panel.

FIG. 1 is a block diagram illustrating a configuration example of a display device 10 according to an embodiment. FIG. 2 is a conceptual diagram of an image display panel 30 and an image-display-panel drive circuit 40 of the display device 10. FIG. 3 is a diagram illustrating an array of pixels 48 and sub-pixels 49 in the image display panel 30.

As illustrated in FIG. 1, the display device 10 includes a signal processing unit 20 that receives an input signal (RGB data) from an image output unit 12 of a control device 11 and performs predetermined data conversion processing on the input signal to output an output signal, the image display panel 30 that displays an image based on the output signal output from the signal processing unit 20, the image-display-panel drive circuit 40 that controls driving of the image display panel (display unit) 30, a light source device 50 that illuminates the image display panel 30 from the back surface, and a light-source-device control circuit 60 that controls driving of the light source device 50.

The signal processing unit 20 is an arithmetic processing unit that controls operations of the image display panel 30 and the light source device 50. The signal processing unit 20 is coupled to the image-display-panel drive circuit 40 for driving the image display panel 30, and to the light-source-device control circuit 60 for driving the light source device 50. The signal processing unit 20 processes the input signal input from the outside to generate an output signal Sout and a light-source-device control signal Spwm (refer to FIG. 6). That is, the signal processing unit 20 generates an output signal including a first color component, a second color component, a third color component, and a fourth color component by converting the input signal into the output signal, and outputs the generated output signal to the image display panel 30. The signal processing unit 20 outputs the generated output signal Sout to the image-display-panel drive circuit 40, and outputs a control signal Sbl based on the generated light-source-device control signal Spwm to the light-source-device control circuit 60 (refer to FIG. 6). The color conversion processing performed by the signal processing unit 20 described above is merely an example, and the present invention is not limited thereto.

As illustrated in FIGS. 2 and 3, in the image display panel 30, $P_0 \times Q_0$ pixels 48 ($P_0$ in a row direction, and $Q_0$ in a column direction) are arrayed in a two-dimensional matrix along the row direction and the column direction. In this example, the row direction is the X-direction, and the column direction is the Y-direction.

The pixel 48 includes, as the sub-pixels 49, a first sub-pixel 49L having the largest display region among the sub-pixels 49 and two second sub-pixels 49U and 49D each having a display region smaller than that of the first sub-pixel 49L. The two second sub-pixels 49U and 49D are aligned in any one of the row direction and the column direction. The two second sub-pixels 49U and 49D aligned in one direction and the first sub-pixel 49L are aligned in the other one of the row direction and the column direction. In this embodiment, as illustrated in FIG. 3, the two second sub-pixels 49U and 49D are aligned in the column direction, and the two second sub-pixels 49U and 49D and the first sub-pixel 49L are aligned in the row direction. Alternatively, the two second sub-pixels 49U and 49D may be aligned in the row direction, and the two second sub-pixels 49U and 49D and the first sub-pixel 49L may be aligned in the column direction. In the example illustrated in FIG. 3, the size of the display region of the second sub-pixel 49U is substantially the same as the size of the display region of the second sub-pixel 49D. In the example illustrated in FIG. 3, the size of the display region combining the two second sub-pixels 49U and 49D is substantially the same as the size of the display region of the first sub-pixel 49L. A signal line DTL overlaps the first sub-pixel 49L, so that an effective display region of the first sub-pixel 49L is reduced. A thin film transistor TFT is provided to each sub-pixel (refer to FIG. 5). Accordingly, two thin film transistors TFT are present in the display region combining the two second sub-pixels 49U and 49D, and one thin film transistor TFT is present in the display region of the first sub-pixel 49L.

The image display panel 30 includes a plurality of scanning lines SCL arranged along the X-direction, and a plurality of signal lines DTL arranged along the Y-direction. FIG. 3 exemplifies a display region of the pixel display panel 30 including four pixels 48 in which three scanning lines Gp+1, Gp+2, and Gp+3 and seven signal lines Sq+1, Sq+2, Sq+3, Sq+4, Sq+5, Sq+6, and Sq+7 are arranged. Each of the other pixels 48 arranged in the pixel display panel 30 has the same structure. In the following description, when the scanning lines Gp+1, Gp+2, and Gp+3 do not need to be distinguished from each other, they may be collectively referred to as the scanning line SCL. When the signal lines Sq+1, Sq+2, Sq+3, Sq+4, Sq+5, Sq+6, and Sq+7 do not need to be distinguished from each other, they may be collectively referred to as the signal line DTL.

In this embodiment, the scanning line SCL arranged on the upper side in the Y-direction of the pixel 48 is coupled to the first sub-pixel 49L and the second sub-pixel 49U, and the scanning line SCL arranged on the lower side of the pixel 48 is coupled to the second sub-pixel 49D. In the pixels 48 vertically adjacent to each other in the Y-direction, some of the sub-pixels 49 share a scanning line SCL. Specifically, the scanning line Gp+1 is coupled to the first sub-pixel 49L and the second sub-pixel 49U of the pixel 48 on the upper side of the display region illustrated in FIG. 3. The scanning line Gp+2 is coupled to the second sub-pixel 49D of the pixel 48 on the upper side of the display region illustrated in FIG. 3, and to the first sub-pixel 49L and the second sub-pixel 49U of the pixel 48 on the lower side thereof. The scanning line Gp+3 is coupled to the second sub-pixel 49D of the pixel 48 on the lower side of the display region illustrated in FIG. 3.

In this embodiment, three signal lines are provided for one column of pixels 48. Among these signal lines, the signal line for the first sub-pixel 49L is arranged at a position overlapping the display region of the first sub-pixel 49L. Specifically, in the display region illustrated in FIG. 3, the signal lines coupled to the left column of the pixels 48 are the signal lines Sq+1, Sq+2, and Sq+3. Among the signal lines Sq+1, Sq+2, and Sq+3, the leftmost signal line Sq+1 is coupled to the second sub-pixel 49U. Among the signal lines Sq+1, Sq+2, and Sq+3, the second signal line Sq+2 from the left is coupled to the second sub-pixel 49D. Among the signal lines Sq+1, Sq+2, and Sq+3, the rightmost signal line Sq+3 is coupled to the first sub-pixel 49L. In the display region illustrated in FIG. 3, the signal lines coupled to the right column of the pixels 48 are the signal lines Sq+4, Sq+5, and Sq+6. Among the signal lines Sq+4, Sq+5, and Sq+6, the leftmost signal line Sq+4 is coupled to the second sub-pixel 49U. Among the signal lines Sq+4, Sq+5, and Sq+6, the second signal line Sq+5 from the left is coupled to the second sub-pixel 49D. Among the signal lines Sq+4, Sq+5, and Sq+6, the rightmost signal line Sq+6 is coupled to the first sub-pixel 49L. The signal lines DTL coupled to the second sub-pixel 49U and the second sub-pixel 49D are arranged at positions overlapping black matrixes arranged between the pixels 48 and between the sub-pixels 49. The signal line DTL coupled to the first sub-pixel 49L is arranged at a position overlapping the display region of the first sub-pixel 49L. The signal line DTL to which the second sub-pixel 49U is coupled may be replaced with the signal line DTL to which the second sub-pixel 49D is coupled.

In this embodiment, a distance between the two signal lines coupled to the respective two second sub-pixels 49U and 49D is different from a distance between the signal line coupled to the first sub-pixel 49L and one signal line coupled to the second sub-pixel. Specifically, a distance between the signal line coupled to the second sub-pixel (for example, the second sub-pixel 49U or 49D) and the signal line coupled to the first sub-pixel (for example, the first sub-pixel 49L) (for example, a distance between the signal line Sq+2 and the signal line Sq+3) is shorter than a distance between the signal lines coupled to the second sub-pixels (for example, the second sub-pixels 49U and 49D) (for example, a distance between the signal line Sq+1 and the signal line Sq+2). As illustrated in FIG. 3, when a width in the X-direction of the first sub-pixel 49L is the same as that of the second sub-pixels 49U and 49D, the distance between the signal line Sq+3 and the signal line for the second sub-pixel (for example, the signal line Sq+2) at a position closer to the signal line Sq+3 becomes shorter than the distance between the signal line Sq+1 and the signal line Sq+2 that are arranged at positions overlapping sides between which the second sub-pixels 49D and 49L are interposed in the Y-direction irrespective of the position at which the signal line Sq+3 overlaps the display region of the first sub-pixel 49L. The same applies to the signal lines Sq+4, Sq+5, and Sq+6, and any signal line DTL coupled to the other pixel 48 (not illustrated). Even if the width in the X-direction of the first sub-pixel 49L is larger than the width in the X-direction of the second sub-pixels 49U and 49D, such a relation about the distance between the signal lines is established by causing the signal lines Sq+3 and Sq+6 overlapping the first sub-pixel 49L to be arranged closer to the second sub-pixels 49U and 49D of the pixel 48 including the first sub-pixel 49L, as illustrated in FIG. 3. In contrast, when the width in the X-direction of the first sub-pixel 49L is larger than the width in the X-direction of the second sub-pixels 49U and 49D, the distance between the signal line overlapping the first sub-pixel 49L (for example, the signal line Sq+3) and the signal line for the second sub-pixel of the same pixel 48 (for example, the signal line Sq+2) closer to the former signal line may be caused to be larger than the distance between the two signal lines coupled to the respective two second sub-pixels 49U and 49D (for example, the distance between the signal line Sq+1 and the signal line Sq+2).

Figure 4:
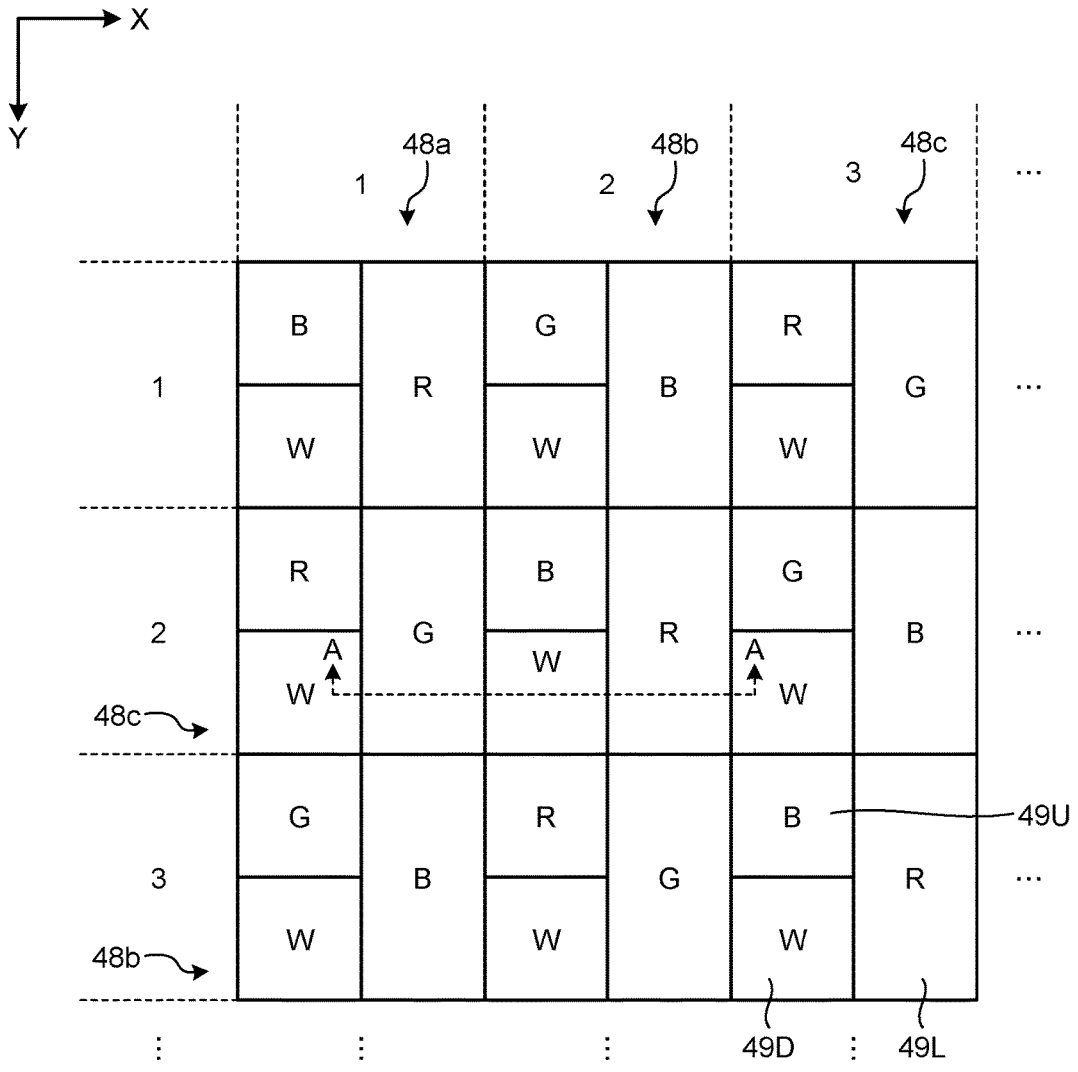
FIG. 4 is a diagram illustrating an arrangement example of colors of sub-pixels included in a plurality of pixels arranged in a row direction and a column direction.

FIG. 4 is a diagram illustrating an arrangement example of colors of the sub-pixels 49 included in the pixels 48 arranged in the row and column directions. The display device displays and outputs an image by combining four or more colors (a predetermined number of colors). The number of colors is four in this embodiment. In the following description, the four colors are referred to as a first color, a second color, a third color, and a fourth color to distinguish them from each other. A combination of the first color, the second color, the third color, and the fourth color is, for example, a combination of red (R), green (G), blue (B), and white (W). In the combination of red (R), green (G), blue (B), and white (W), a high luminance color is white (W).

The display device includes a plurality of pixels each including three or more sub-pixels the number of which is smaller than the number of colors. Specifically, as described above with reference to FIGS. 1 to 3, the display device according to the embodiment includes a plurality of pixels 48 each including three sub-pixels 49. In this way, the image display panel 30 includes a plurality of partial regions (a plurality of pixels 48) arranged in a matrix.

The sub-pixels 49 included in one pixel 48 output different colors. Specifically, as illustrated in FIG. 4, the combination of the colors of the sub-pixels 49 included in the pixel 48 is as follows: a combination of red (R), green (G), and white (W); a combination of red (R), blue (B), and white (W); or a combination of green (G), blue (B), and white (W). That is, the same color is not arranged in two or more sub-pixels 49 included in one pixel 48.

One of the two second sub-pixels 49U and 49D outputs a high luminance color having the highest luminance. Specifically, all the pixels 48 include the second sub-pixel 49D of white (W). In this way, white (W) as the high luminance color is arranged as the color of the second sub-pixel 49D in this embodiment. In FIG. 4, white (W) as the high luminance color is arranged in the second sub-pixel 49D. Alternatively, the color of the second sub-pixel 49U may be replaced with the color of the second sub-pixel 49D. That is, white (W) as the high luminance color may be arranged in the second sub-pixel 49U. In this way, the color having the highest luminance among the predetermined number of colors is assigned to one of second display regions (the second sub-pixels).

In this embodiment, the combination of the colors of the sub-pixels 49 is different in each of the pixels 48 adjacent to each other in the row direction and the column direction. Specifically, the combination of the colors of the sub-pixels 49 included in the pixel 48 adjacent to the pixel 48 having the combination of the colors of the sub-pixels 49 of red (R), green (G), and white (W) is the combination of red (R), blue (B), and white (W) or the combination of green (G), blue (B), and white (W). The combination of the colors of the sub-pixels 49 included in the pixel 48 adjacent to the pixel 48 having the combination of the colors of the sub-pixels 49 of red (R), blue (B), and white (W) is the combination of red (R), green (G), and white (W) or the combination of green (G), blue (B), and white (W). The combination of the colors of the sub-pixels 49 included in the pixel 48 adjacent to the pixel 48 having the combination of the colors of the sub-pixels 49 of green (G), blue (B), and white (W) is the combination of red (R), green (G), and white (W) or the combination of red (R), blue (B), and white (W).

In this embodiment, the arrangement of the colors of the sub-pixels 49 is periodically repeated in units of a predetermined number of pixels continuous in the row direction and the column direction. Specifically, as illustrated in FIG. 4, in the image display panel 30 according to the embodiment, a pixel 48*a* including the second sub-pixel 49U of blue (B) and the first sub-pixel 49L of red (R), a pixel 48*b* including the second sub-pixel 49U of green (G) and the first sub-pixel 49L of blue (B), and a pixel 48*c* including the second sub-pixel 49U of red (R) and the first sub-pixel 49L of green (G) are repeatedly and periodically arranged in units of three pixels along the row direction. In the image display panel 30 according to the embodiment, the pixel 48*a* including the second sub-pixel 49U of blue (B) and the first sub-pixel 49L of red (R), the pixel 48*c* including the second sub-pixel 49U of red (R) and the first sub-pixel 49L of green (G), and the pixel 48*b* including the second sub-pixel 49U of green (G) and the first sub-pixel 49L of blue (B) are repeatedly and periodically arranged in units of three pixels along the column direction. As described above, the color of the second sub-pixel 49D included in each of the pixel 48*a*, the pixel 48*b*, and the pixel 48*c* is white (W).

In the example illustrated in FIG. 4, the pixels 48 are repeatedly and periodically arranged in the (3γ-2)-th row in units of three pixels in order of the pixel 48*a*, the pixel 48*b*, and the pixel 48*c* from the left along the row direction. In the (3γ-1)-th row, the pixels 48 are repeatedly and periodically arranged in units of three pixels in order of the pixel 48*c*, the pixel 48*a*, and the pixel 48*b* from the left along the row direction. In the 3γth row, the pixels 48 are repeatedly and periodically arranged in units of three pixels in order of the pixel 48*b*, the pixel 48*c*, and the pixel 48*a* from the left along the row direction. That is, in the (3γ-2)-th column, the pixels 48 are repeatedly and periodically arranged in units of three pixels in order of the pixel 48*a*, the pixel 48*c*, and the pixel 48*b* from the top along the column direction. In the (3γ-1)-th column, the pixels 48 are repeatedly and periodically arranged in units of three pixels in order of the pixel 48*b*, the pixel 48*a*, and the pixel 48*c* from the top along the column direction. In the 3γth column, the pixels 48 are repeatedly and periodically arranged in units of three pixels in order of the pixel 48*c*, the pixel 48*b*, and the pixel 48*a* from the top along the column direction. In this case, γ is a natural number. The arrangement order of the pixel 48*a*, the pixel 48*b*, and the pixel 48*c* in the row and column directions can be appropriately modified.

Figure 5:
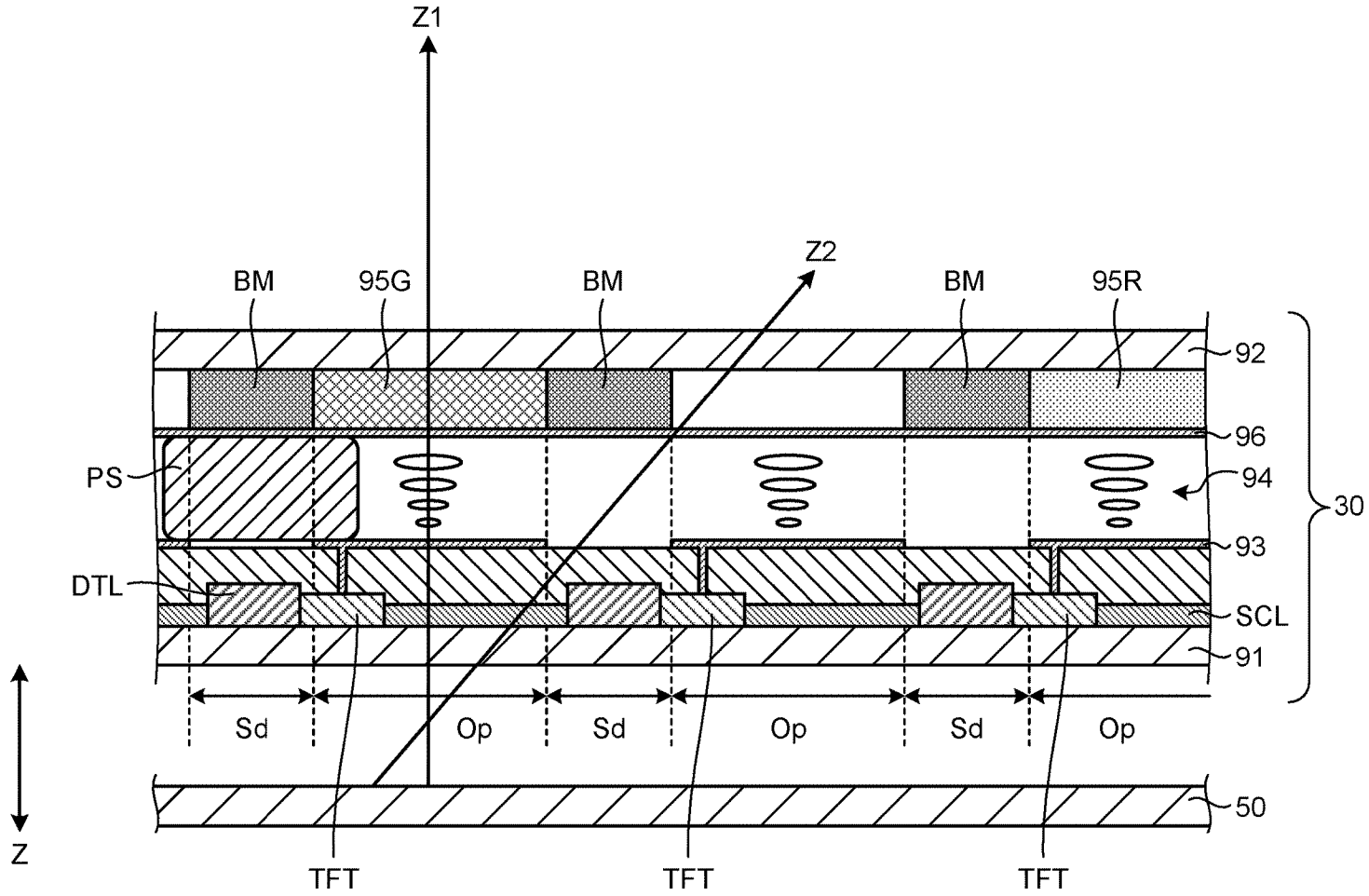
FIG. 5 is a schematic diagram of a cross section along A-A illustrated in FIG. 4.

FIG. 5 is a schematic diagram of a cross section along A-A illustrated in FIG. 4. The display device 10 according to the embodiment is a transmissive color liquid crystal display device. The image display panel 30 is a color liquid crystal display panel, and includes, as illustrated in FIG. 5 for example, a pixel substrate 91 to which the thin film transistor TFT and a pixel electrode 93 are provided in addition to the scanning line SCL and the signal line DTL, and a counter substrate 92 to which a common electrode 96 is provided, the counter substrate 92 being opposed to the pixel substrate 91 across a liquid crystal layer 94 and a photo spacer PS. A positional relation between the pixel electrode 93 and the common electrode 96 is not limited to the relation illustrated in FIG. 5. The electrodes may be arranged on only one substrate, for example, only the pixel substrate 91, or the positional relation between the pixel electrode and the common electrode with respect to the Z-direction may be reversed.

The image display panel 30 includes a color filter arranged for obtaining light of four or more predetermined number of colors. Specifically, in the image display panel 30, a first color filter 95R for transmitting a first primary color is arranged between the sub-pixel 49 of red (R) and an image observer, and a second color filter 95G for transmitting a second primary color is arranged between the sub-pixel 49 of green (G) and the image observer. Although not illustrated, in the image display panel 30, a third color filter for transmitting a third primary color is arranged between the sub-pixel 49 of blue (B) and the image observer. In the image display panel 30, no color filter is arranged between the sub-pixel 49 of white (W) and the image observer. A transparent resin layer may be provided in place of the color filter to the sub-pixel 49 of white (W). The image display panel 30 thus provided with the transparent resin layer can suppress occurrence of a large gap above the sub-pixel 49 of white (W), otherwise a large gap occurs because no color filter is arranged for the sub-pixel 49 of white (W). A resin layer as a color filter corresponding to white (W) may not be arranged. As illustrated in FIG. 5, the color filters such as the first color filter 95R, the second color filter 95G, and the third color filter may be arranged on the counter substrate 92 side (upper side) as a light emitting surface with respect to the liquid crystal layer 94, or arranged on the pixel substrate 91 side (lower side). As described above, the pixel 48 includes three or more sub-pixels 49 the number of which is smaller than the number of colors, so that the color filters corresponding to three or more colors the number of which is smaller than the predetermined number (the number of colors) are arranged in each partial region (each of the pixels 48).

A black matrix BM is arranged between spaces in which the color filters are arranged. In FIG. 5, a region in which light is shielded by the black matrix BM is denoted by a reference symbol Sd, and an opening between black matrixes BM is denoted by a reference symbol Op. The light may be shielded by overlapped color filters in place of the black matrix BM.

The display device 10 may be a display device that lights a self-luminous body such as an organic light-emitting diode (OLED), or may be a micro electro-mechanical system (MEMS) display device. The color liquid crystal display panel may be, for example, a liquid crystal panel of lateral electric-field mode such as an In-Plane Switching (IPS) display panel, and liquid crystals used for a liquid crystal layer thereof are liquid crystals suitable for the liquid crystal panel. However, the color liquid crystal display panel is not limited to the liquid crystal panel of lateral electric-field mode, and may be a liquid crystal display panel of longitudinal electric-field mode. The liquid crystals constituting the liquid crystal layer may be appropriately modified depending on the liquid crystal panel. For example, the liquid crystals used for the liquid crystal layer may be driven by various modes such as a twisted nematic (TN) mode, a vertical alignment (VA) mode, and an electrically controlled birefringence (ECB) mode.

In the color liquid crystal display panel in which the color of the sub-pixel 49 corresponds to the color of the color filter, as indicated by the arrow Z1 in FIG. 5, light emitted from the light source device 50 functioning as a backlight is assumed to be emitted toward the sub-pixel 49 immediately thereabove. On the other hand, as indicated by the arrow Z2 in FIG. 5, light leakage toward an adjacent sub-pixel 49 may be caused. Thus, in the display region in which the sub-pixels 49 provided with the color filters of different colors are adjacent to each other, the light leakage may cause a viewing angle color mixing phenomenon in which the sub-pixel 49 of different color seems to be lit. In this embodiment, all of the second sub-pixels 49D are the sub-pixel 49 of white (W), so that the light passing through the second sub-pixel 49D does not pass through a color filter even if the light leakage is caused. That is, in this embodiment, the viewing angle color mixing phenomenon due to the light leakage can be prevented in the region in which the second sub-pixel 49D is arranged in the row direction or the column direction. FIG. 5 illustrates an example in which the light leaked from the first sub-pixel 49L of green (G) passes through the second sub-pixel 49D. The same applies to first sub-pixels 49L of other colors.

Next, the following describes processing performed by the signal processing unit 20. As described above, the signal processing unit 20 generates the output signal including the first color component, the second color component, the third color component, and the fourth color component by converting the input signal into the output signal, and outputs the generated output signal to the image display panel 30. That is, the signal processing unit 20 performs signal processing of determining outputs of the pixels based on the input signal.

Figure 6:
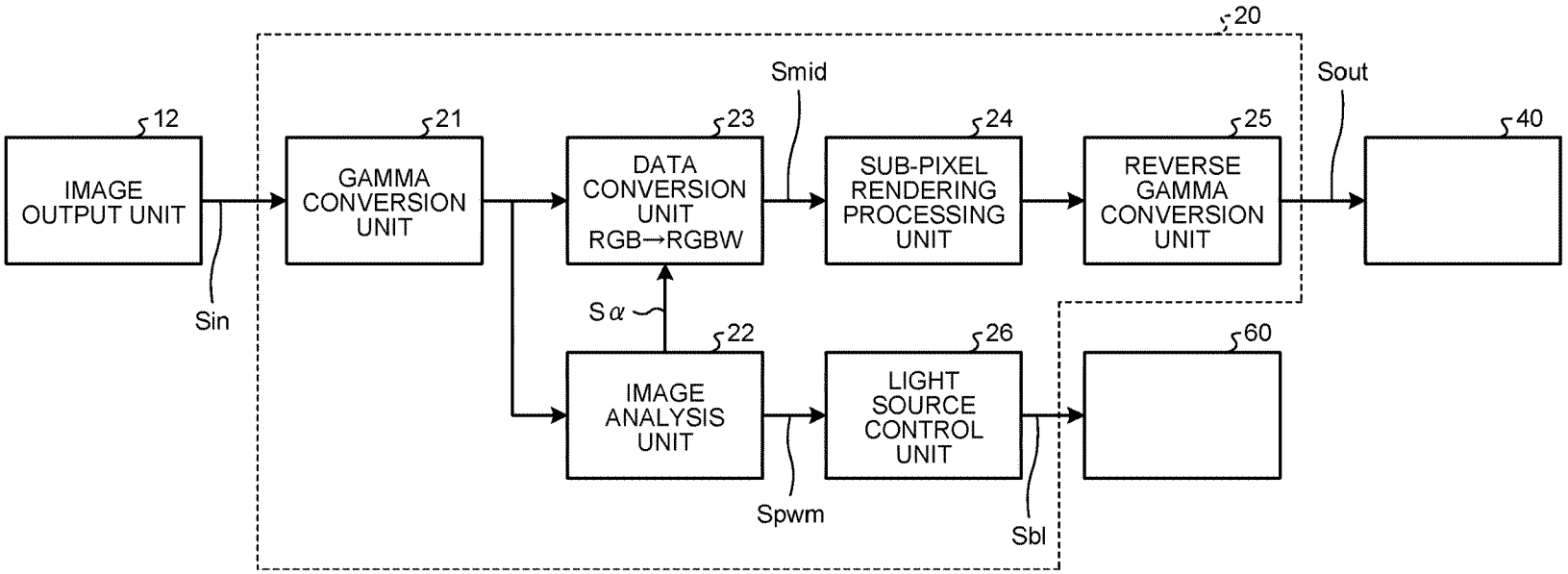
FIG. 6 is a block diagram for illustrating a signal processing unit of the display device.

FIG. 6 is a block diagram for illustrating the signal processing unit of the display device. As illustrated in FIG. 6, the signal processing unit 20 includes a gamma conversion unit 21 that receives an input signal Sin (RGB data) from the image output unit 12, an image analysis unit 22, a data conversion unit 23, a sub-pixel rendering processing unit 24, a reverse gamma conversion unit 25, and a light source control unit 26. The gamma conversion unit 21 performs gamma conversion processing on the input signal Sin (RGB data). The image analysis unit 22 calculates, based on the input value on which gamma conversion processing is performed, control information Sα on an expansion coefficient α described later and the light-source-device control signal Spwm based on the expansion coefficient α. The light source control unit 26 controls the light-source-device control circuit 60 with the control signal Sbl based on the light-source-device control signal Spwm.

The data conversion unit 23 determines and outputs an output intermediate signal Smid for each sub-pixel 49 in all of the pixels 48 based on the input value on which gamma conversion processing is performed and the control information Sαon the expansion coefficient α. The sub-pixel rendering processing unit 24 performs thinning processing in matching with a pixel array of the image display panel 30, and performs color correction. The reverse gamma conversion unit 25 outputs, to the image-display-panel drive circuit 40, the output signal Sout on which reverse gamma conversion processing is performed based on processing information on the sub-pixel rendering processing unit 24. The data conversion unit 23 and the reverse gamma conversion unit 25 are not essential, and the gamma conversion processing and the reverse gamma conversion processing are not necessarily performed.

The image-display-panel drive circuit 40 includes a signal output circuit 41 and a scanning circuit 42. The image-display-panel drive circuit 40 holds a video signal with the signal output circuit 41, and sequentially outputs the video signal to the image display panel 30. The signal output circuit 41 is electrically coupled to the image display panel 30 via the signal line DTL. The image-display-panel drive circuit 40 controls ON and OFF of a switching element (for example, the thin film transistor TFT) for controlling an operation of the sub-pixel (light transmittance) in the image display panel 30 based on a signal (scanning signal) from the scanning circuit 42. The scanning circuit 42 is electrically coupled to the image display panel 30 via the scanning line SCL.

The light source device 50 is arranged at the back surface side of the image display panel 30, and irradiates the image display panel 30 with light to illuminate the image display panel 30. The light source device 50 irradiates with light the entire surface of the image display panel 30 to brighten the image display panel 30. The light-source-device control circuit 60 controls, for example, an amount of the light output from the light source device 50. Specifically, the light-source-device control circuit 60 controls the amount of light (intensity of light) emitted to the image display panel 30 by adjusting a duty ratio or a voltage supplied to the light source device 50 based on the light-source-device control signal output from the signal processing unit 20. Next, the following describes a processing operation performed by the display device 10, more specifically, by the signal processing unit 20. The light source device 50 may be able to adjust the luminance for each partial region as part of the region of the image display panel 30. In this case, the image analysis unit 22 may generate the expansion coefficient α and the light-source-device control signal Spwm for each partial region, and the data conversion unit 23 and the light source control unit 26 may perform conversion processing for generating RGBW data and light source control, respectively, for each partial region.

Figure 7:
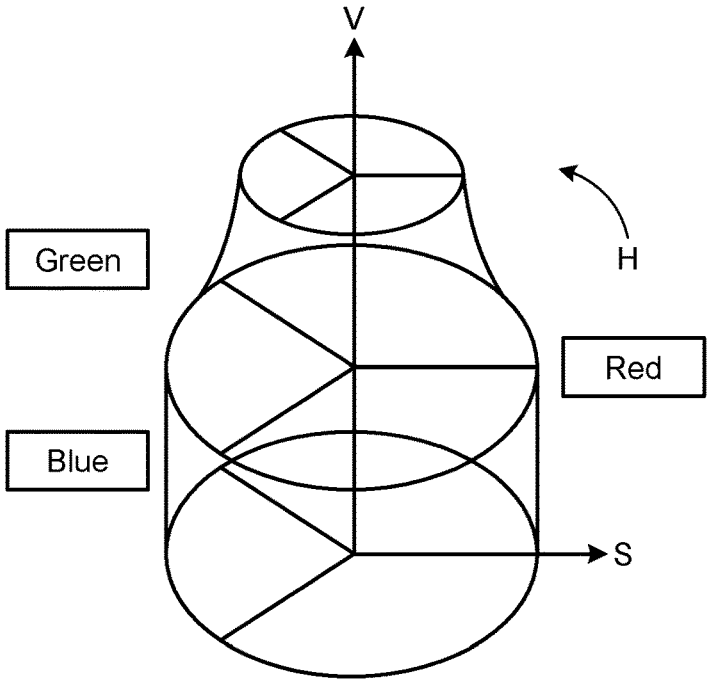
FIG. 7 is a conceptual diagram of an extended HSV color space that can be extended with the display device according to the embodiment.
Figure 8:
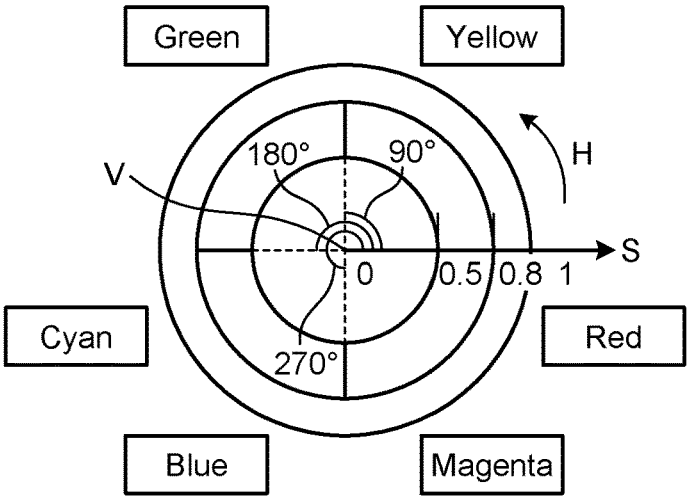
FIG. 8 is a conceptual diagram illustrating a relation between a hue and saturation in the extended HSV color space.

FIG. 7 is a conceptual diagram of the extended HSV (Hue-Saturation-Value, Value is also called Brightness)

color space that can be extended with the display device according to the embodiment. FIG. 8 is a conceptual diagram illustrating a relation between a hue and saturation in the extended HSV color space. The signal processing unit 20 receives an input signal from the outside as information on an image to be displayed. The input signal includes, as the input signal, information on the image (color) to be displayed at its position for each pixel. Specifically, in the image display panel 30 in which $P_0 \times Q_0$ pixels 48 are arranged in a matrix, with respect to the (p, q)-th pixel 48 (where $1 \leq p \leq P_0$, $1 \leq q \leq Q_0$), a signal including a first color input signal (signal value $x_{1-(p,\ q)}$) that is the input signal for the sub-pixel 49 of red (R), a second color input signal (signal value $x_{2-(p,\ q)}$) that is the input signal for the sub-pixel 49 of green (G), and a third color input signal (signal value $x_{3-(p,\ q)}$) that is the input signal for the sub-pixel 49 of blue (B) is input to the signal processing unit 20 (refer to FIG. 1).

The signal processing unit 20 illustrated in FIG. 1 processes the input signal to generate a first color output signal (signal value $X_{1-(p,\ q)}$) for determining display gradation of the sub-pixel 49 of red (R), a second color output signal (signal value $X_{2-(p,\ q)}$) for determining display gradation of the sub-pixel 49 of green (G), a third color output signal (signal value $X_{3-(p,\ q)}$) for determining display gradation of the sub-pixel 49 of blue (B), and a fourth color output signal (signal value $X_{4-(p,\ q)}$) for determining display gradation of the sub-pixel 49 of white (W), and outputs the output signals to the image-display-panel drive circuit 40.

By causing the pixel 48 to include the sub-pixel 49 of white (W) that outputs a component of high luminance color (for example, white), as illustrated in FIG. 7, the display device 10 can widen a dynamic range of brightness in an HSV color space (extended HSV color space). That is, as illustrated in FIG. 7, a substantially truncated cone in which a maximum value of brightness V is reduced as saturation S increases is placed on a cylindrical HSV color space that can be displayed with the sub-pixel 49 of red (R), the sub-pixel 49 of green (G), and the sub-pixel 49 of blue (B).

The signal processing unit 20 stores a maximum value Vmax(S) of the brightness using the saturation S as a variable in the HSV color space expanded by adding the component of high luminance color (for example, white). That is, the signal processing unit 20 stores therein the maximum value Vmax(S) of the brightness for each coordinates (coordinate values) of the saturation and the hue for a three-dimensional HSV color space illustrated in FIG. 7. The input signal includes the input signals for the sub-pixel 49 of red (R), the sub-pixel 49 of green (G), and the sub-pixel 49 of blue (B), so that the HSV color space of the input signal has a cylindrical shape, that is, the same shape as a cylindrical portion of the extended HSV color space.

The signal processing unit 20 calculates the output signal (signal value $X_{1-(p,\ q)}$) for the sub-pixel 49 of red (R) based on at least the input signal (signal value $x_{1-(p,\ q)}$) and the expansion coefficient α for the sub-pixel 49 of red (R), and outputs the output signal to the sub-pixel 49 of red (R). The signal processing unit 20 calculates the output signal (signal value $X_{2-(p,\ q)}$) for the sub-pixel 49 of green (G) based on at least the input signal (signal value $x_{2-(p,\ q)}$) and the expansion coefficient α for the sub-pixel 49 of green (G), and outputs the output signal to the sub-pixel 49 of green (G). The signal processing unit 20 calculates the output signal (signal value $X_{3-(p,\ q)}$) for the sub-pixel 49 of blue (B) based on at least the input signal (signal value $x_{3-(p,\ q)}$) and the expansion coefficient α for the sub-pixel 49 of blue (B), and outputs the output signal to the sub-pixel 49 of blue (B). The signal processing unit 20 also calculates the output signal (signal value $X_{4-(p,\ q)}$) for the sub-pixel 49 of white (W) based on the input signal (signal value $x_{1-(p,\ q)}$) for the sub-pixel 49 of red (R), the input signal (signal value $x_{2-(p,\ q)}$) for the sub-pixel 49 of green (G), and the input signal (signal value $x_{3-(p,\ q)}$) for the sub-pixel 49 of blue (B), and outputs the output signal to the sub-pixel 49 of white (W).

Specifically, the signal processing unit 20 calculates the output signal for the sub-pixel 49 of red (R) based on the expansion coefficient α for the sub-pixel 49 of red (R) and the output signal for the sub-pixel 49 of white (W), calculates the output signal for the sub-pixel 49 of green (G) based on the expansion coefficient α for the sub-pixel 49 of green (G) and the output signal for the sub-pixel 49 of white (W), and calculates the output signal for the sub-pixel 49 of blue (B) based on the expansion coefficient α for the sub-pixel 49 of blue (B) and the output signal for the sub-pixel 49 of white (W).

That is, assuming that χ is a constant depending on the display device 10, the signal processing unit 20 obtains, through the following expressions (1) to (3), the signal value $X_{1-(p,\ q)}$ as the output signal for the sub-pixel 49 of red (R), the signal value $X_{2-(p,\ q)}$ as the output signal for the sub-pixel 49 of green (G), and the signal value $X_{3-(p,\ q)}$ as the output signal for the sub-pixel 49 of blue (B) in the (p, q)-th pixel (or a group of the sub-pixel 49 of red (R), the sub-pixel 49 of green (G), and the sub-pixel 49 of blue (B)).

$$X_{1-(p,\ q)} = \alpha \cdot x_{1-(p,\ q)} - \chi \cdot X_{4-(p,\ q)} \tag{1}$$

$$X_{2-(p,\ q)} = \alpha \cdot x_{2-(p,\ q)} - \chi \cdot X_{4-(p,\ q)} \tag{2}$$

$$X_{3-(p,\ q)} = \alpha \cdot x_{3-(p,\ q)} - \chi \cdot X_{4-(p,\ q)} \tag{3}$$

The signal processing unit 20 obtains the maximum value Vmax(S) of the brightness using the saturation S as a variable in the HSV color space expanded by adding the fourth color, obtains the saturation S and the brightness V(S) of a plurality of pixels 48 based on input signal values for the sub-pixels 49 of the pixels 48, and determines the expansion coefficient α so that a ratio of the pixels 48 in which an expanded value of the brightness obtained by multiplying the brightness V(S) by the expansion coefficient α exceeds the maximum value Vmax(S) to all the pixels is equal to or smaller than a limit value β (Limit value). The limit value β is an upper limit value (ratio) of a range of exceeding the maximum value with respect to the maximum value of the brightness in the extended HSV color space with a combination of the values of the hue and the saturation.

The saturation S and the brightness V(S) are represented as S=(Max−Min)/Max and V(S)=Max. The saturation S takes a value from 0 to 1, the brightness V(S) takes a value from 0 to $(2^n-1)$, and n is a display gradation bit number. Max is a maximum value among the input signal values for three sub-pixels in the pixel, that is, a first color input signal value, a second color input signal value, and a third color input signal value. Min is a minimum value among the input signal values for three sub-pixels in the pixel, that is, the first color input signal value, the second color input signal value, and the third color input signal value. A hue H is represented in a range from 0° to 360° as illustrated in FIG. 8. From 0° to 360°, the hue H is red (R), yellow (Y), green (G), cyan (C), blue (B), magenta (M), and red. In this embodiment, a region including an angle 0° is red, a region including the angle 120° is green, and a region including the angle 240° is blue.

In this embodiment, the signal value $X_{4-(p,\ q)}$ can be obtained based on a product of $Min_{(p,\ q)}$ and the expansion coefficient α. Specifically, the signal value $X_{4-(p,\ q)}$ can be obtained based on the following expression (4). In the expression (4), the product of $Min_{(p, q)}$ and the expansion coefficient $\alpha$ is divided by $\chi$, but the embodiment is not limited thereto. Description of $\chi$ will be provided later. The expansion coefficient $\alpha$ is determined for each image display frame.

$$X_{4-(p, q)}=Min_{(p, q)}\cdot\alpha/\chi \quad (4)$$

Typically, with respect to the (p, q)-th pixel, the saturation $S_{(p, q)}$ and the brightness $V(S)_{(p, q)}$ in the cylindrical HSV color space can be obtained through the following expressions (5) and (6) based on the input signal (signal value $x_{1-(p, q)}$) for the sub-pixel 49 of red (R), the input signal (signal value $x_{2-(p, q)}$) for the sub-pixel 49 of green (G), and the input signal (signal value $x_{3-(p, q)}$) for the sub-pixel 49 of blue (B).

$$S_{(p, q)}=(Max_{(p, q)}-Min_{(p, q)})/Max_{(p, q)} \quad (5)$$

$$V(S)_{(p, q)}=Max_{(p, q)} \quad (6)$$

In this case, $Max_{(p, q)}$ is the maximum value among the input signal values for three sub-pixels 49, that is, ($x_{1-(p, q)}$, $x_{2-(p, q)}$, $x_{3-(p, q)}$), and $Min_{(p, q)}$ is the minimum value among the input signal values for three sub-pixels 49, that is, ($x_{1-(p, q)}$, $x_{2-(p, q)}$, $x_{3-(p, q)}$). In this embodiment, n=8 is assumed. That is, the display gradation bit number is assumed to be 8 (the value of display gradation is 256, that is, 0 to 255).

No color filter is provided to the sub-pixel 49 of white (W) that displays white. In a case in which a signal having a value corresponding to a maximum signal value of the first color output signal is input to the sub-pixel 49 of red (R), a signal having a value corresponding to the maximum signal value of the second color output signal is input to the sub-pixel 49 of green (G), and a signal having a value corresponding to the maximum signal value of the third color output signal is input to the sub-pixel 49 of blue (B), luminance of an aggregate of the sub-pixel 49 of red (R), the sub-pixel 49 of green (G), and the sub-pixel 49 of blue (B) included in the pixel 48 or a group of the pixels 48 is assumed to be $BN_{1-3}$. The luminance of the sub-pixel 49 of white (W) is assumed to be $BN_4$ in a case in which a signal having a value corresponding to the maximum signal value of the output signal for the sub-pixel 49 of white (W) is input to the sub-pixel 49 of white (W) included in the pixel 48 or a group of the pixels 48. That is, white with the maximum luminance is displayed by the aggregate of the sub-pixel 49 of red (R), the sub-pixel 49 of green (G), and the sub-pixel 49 of blue (B), and the luminance of white is represented as $BN_{1-3}$. Assuming that $\chi$ is a constant depending on the display device 10, the constant $\chi$ is represented as $\chi=BN_4/BN_{1-3}$.

Specifically, the luminance $BN_4$ in a case in which the input signal having a display gradation value of 255 is assumed to be input to the sub-pixel 49 of white (W) is, for example, 1.5 times the luminance $BN_{1-3}$ of white in a case in which the signal value $x_{1-(p, q)}=255$, the signal value $x_{2-(p, q)}=255$, and the signal value $x_{3-(p, q)}=255$ are input to the aggregate of the sub-pixel 49 of red (R), the sub-pixel 49 of green (G), and the sub-pixel 49 of blue (B) as input signals having the above display gradation value. That is, $\chi=1.5$ in this embodiment.

When the signal value $X_{4-(p, q)}$ is given by the above expression (4), Vmax(S) can be represented by the following expressions (7) and (8).

When $S\leq S_0$, $$Vmax(S)=(\chi+1)\cdot(2^n-1) \quad (7)$$

When $S_0<S\leq 1$, $$Vmax(S)=(2^n-1)\cdot(1/S) \quad (8)$$

In this case, $S_0=1/(\chi+1)$.

The thus obtained maximum value Vmax(S) of the brightness using the saturation S as a variable in the HSV color space expanded by adding the component of high luminance color is stored, for example, as a kind of look-up table in the signal processing unit 20. Alternatively, the maximum value Vmax(S) of the brightness using the saturation S as a variable in the expanded HSV color space is obtained by the signal processing unit 20 as occasion demands.

Next, the following describes a method (expansion processing) of obtaining the output signals for the (p, q)-th pixel 48, that is, the signal values of $X_{1-(p, q)}$, $X_{2-(p, q)}$, $X_{3-(p, q)}$, and $X_{4-(p, q)}$. The following processing is performed while maintaining a ratio between the luminance of the first primary color displayed by (sub-pixel 49 of red (R)+sub-pixel 49 of white (W)), the luminance of the second primary color displayed by (sub-pixel 49 of green (G)+sub-pixel 49 of white (W)), and the luminance of the third primary color displayed by (sub-pixel 49 of blue (B)+sub-pixel 49 of white (W)). The processing is performed while keeping (maintaining) a color tone. Additionally, the processing is performed while keeping (maintaining) a gradation-luminance characteristic (gamma characteristic, $\gamma$ characteristic). When all of the input signal values for any of the pixels 48 or any group of the pixels 48 are 0 or small, the expansion coefficient $\alpha$ may be obtained without including such a pixel 48 or a group of the pixels 48.

First Process

First, the signal processing unit 20 obtains the saturation S and the brightness V(S) for a plurality of pixels 48 based on the input signal values for the sub-pixels 49 of the pixels 48. Specifically, the signal processing unit 20 obtains $S_{(p, q)}$ and $V(S)_{(p, q)}$ through the expressions (5) and (6) based on the signal value $x_{1-(p, q)}$ as the input signal for the sub-pixel 49 of red (R) in the (p, q)-th pixel 48, the signal value $x_{2-(p, q)}$ as the input signal for the sub-pixel 49 of green (G) in the (p, q)-th pixel 48, and the signal value $x_{3-(p, q)}$ as the input signal for the sub-pixel 49 of blue (B) in the (p, q)-th pixel 48. The signal processing unit 20 performs this processing on all of the pixels 48.

Second Process

Subsequently, the signal processing unit 20 obtains the expansion coefficient $\alpha(S)$ based on Vmax(S)/V(S) obtained for the pixels 48.

$$\alpha(S)=Vmax(S)/V(S) \quad (9)$$

The values of the expansion coefficient $\alpha(S)$ obtained for the pixels (in this embodiment, all of $P_0\times Q_0$ pixels) 48 are arranged in ascending order, and the ($\beta\times P_0\times Q_0$)-th expansion coefficient $\alpha(S)$ from the minimum value among $P_0\times Q_0$ values of the expansion coefficient $\alpha(S)$ is assumed to be the expansion coefficient $\alpha$. In this way, the expansion coefficient $\alpha$ can be determined so that the ratio of the pixels in which the expanded value of the brightness obtained by multiplying the brightness V(S) by the expansion coefficient $\alpha$ exceeds the maximum value Vmax(S) to all the pixels is equal to or smaller than the predetermined value ($\beta$).

Third Process

Next, the signal processing unit 20 obtains the signal value $X_{4-(p, q)}$ for the (p, q)-th pixel 48 based on at least the signal value $x_{1-(p, q)}$, the signal value $x_{2-(p, q)}$, and the signal value $x_{3-(p, q)}$ of the input signals. In this embodiment, the signal processing unit 20 determines the signal value $X_{4-(p, q)}$ based on $Min_{(p, q)}$, the expansion coefficient $\alpha$, and the constant $\chi$. More specifically, as described above, the signal processing unit 20 obtains the signal value $X_{4-(p,\ q)}$ based on the expression (4) described above. The signal processing unit 20 obtains the signal value $X_{4-(p,\ q)}$ for all of the $P_0 \times Q_0$ pixels 48.

Fourth Process

Subsequently, the signal processing unit 20 obtains the signal value $X_{1-(p,\ q)}$ for the (p, q)-th pixel 48 based on the signal value $x_{1-(p,\ q)}$, the expansion coefficient $\alpha$, and the signal value $X_{4-(p,\ q)}$, obtains the signal value $X_{2-(p,\ q)}$ for the (p, q)-th pixel 48 based on the signal value $X_{2-(p,\ q)}$, the expansion coefficient $\alpha$, and the signal value $X_{4-(p,\ q)}$, and obtains the signal value $X_{3-(p,\ q)}$ for the (p, q)-th pixel 48 based on the signal value $x_{3-(p,\ q)}$, the expansion coefficient $\alpha$, and the signal value $X_{4-(p,\ q)}$. Specifically, the signal processing unit 20 obtains the signal value $X_{1-(p,\ q)}$, the signal value $X_{2-(p,\ q)}$, and the signal value $X_{3-(p,\ q)}$ for the (p, q)-th pixel 48 based on the expressions (1) to (3) described above.

As represented by the expression (4), the signal processing unit 20 expands the value of $Min_{(p,\ q)}$ with $\alpha$. In this way, when the value of $Min_{(p,\ q)}$ is expanded with $\alpha$, not only the luminance of a white display sub-pixel (the sub-pixel 49 of white (W)) but also the luminance of a red display sub-pixel, a green display sub-pixel, and a blue display sub-pixel (corresponding to the sub-pixel 49 of red (R), the sub-pixel 49 of green (G), and the sub-pixel 49 of blue (B), respectively) is increased as represented by the expression described above. Accordingly, dullness in color can be prevented from being caused. That is, when the value of $Min_{(p,\ q)}$ is expanded with $\alpha$, the luminance of the entire image is increased by $\alpha$ times as compared with a case in which the value of $Min_{(p,\ q)}$ is not expanded. Thus, for example, an image such as a static image can be displayed with high luminance, which is preferable.

The luminance displayed with the output signals $X_{1-(p,\ q)}$, $X_{2-(p,\ q)}$, $X_{3-(p,\ q)}$, and $X_{4-(p,\ q)}$ for the (p, q)-th pixel 48 is expanded to be $\alpha$times the luminance formed with the input signals $x_{1-(p,\ q)}$, $x_{2-(p,\ q)}$, and $x_{3-(p,\ q)}$. Thus, to cause the luminance of the pixel 48 to be the same as the luminance of the pixel 48 that is not expanded, the display device 10 may reduce the luminance of the light source device 50 based on the expansion coefficient $\alpha$. Specifically, the luminance of the light source device 50 may be multiplied by $(1/\alpha)$.

As described above, the display device 10 according to this embodiment can cause the expansion coefficient $\alpha$ to be a value that can reduce power consumption while maintaining display quality by setting the limit value $\beta$ for each frame of the input signal.

Figure 9:
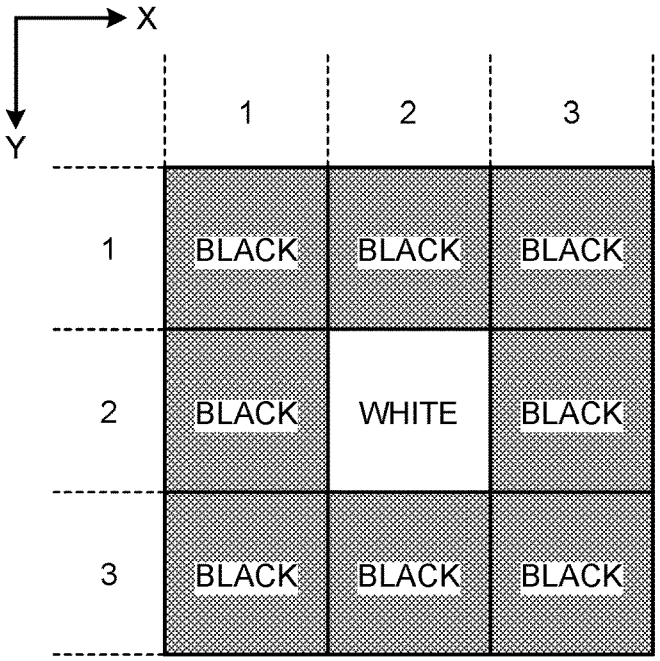
FIG. 9 is a diagram illustrating an example of content of a display output indicated by an input signal.
Figure 10:
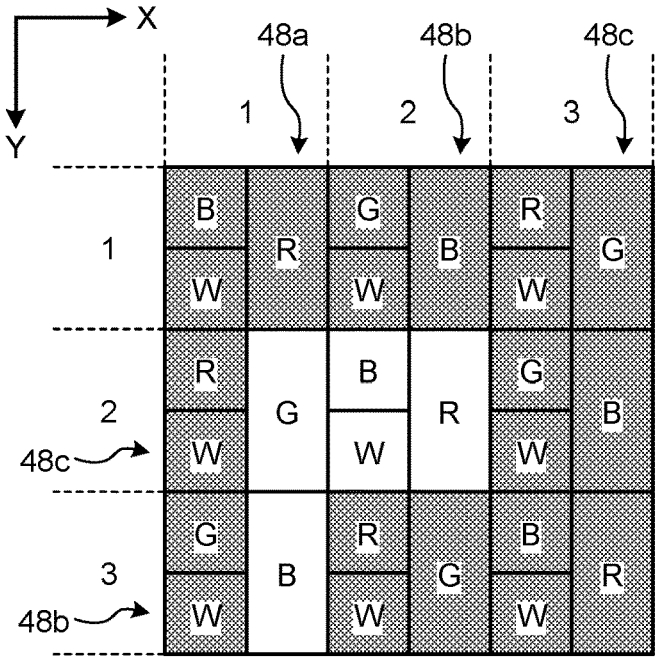
FIG. 10 is a diagram illustrating an example of the display output in a case in which sub-pixel rendering processing is applied to the input signal illustrated in FIG. 9.

FIG. 9 is a diagram illustrating an example of content of the display output indicated by the input signal. FIG. 10 is a diagram illustrating an example of the display output in a case in which sub-pixel rendering processing is applied to the input signal illustrated in FIG. 9. In outputting a color that cannot be reproduced with the sub-pixels 49 included in one pixel 48, the signal processing unit 20 outputs the color using the sub-pixel 49 that is included in the other pixel 48 and required for reproducing the color.

For example, as illustrated in FIG. 9, assumed is a case in which an input signal indicating that only one pixel is white, for example, (R, G, B)=(255, 255, 255), and all of the other pixels around the one pixel are black, that is, (R, G, B)=(0, 0, 0), is input. Each of the pixel 48*a*, the pixel 48*b*, and the pixel 48*c* does not include all of the colors of red (R), green (G), and blue (B) as the colors of the sub-pixels 49, that is, any one of the colors is not included. Thus, when the pixel 48 at the position corresponding to the white pixel illustrated in FIG. 9 is any of the pixel 48*a*, the pixel 48*b*, and the pixel 48*c*, the pixel 48 at the position does not include all of red (R), green (G), and blue (B), so that white cannot be reproduced with only one pixel 48 when the sub-pixels 49 other than the second sub-pixel 49D of white (W) are lit. In this embodiment, it is not assumed to produce an output indicating relatively high luminance within a range of output luminance that can be indicated by the input signal such as (R, G, B)=(255, 255, 255) with only the second sub-pixel 49D of white (W). Accordingly, in this case, white is the color that cannot be reproduced with the colors of the sub-pixels included in one pixel 48. The size of the first sub-pixel 49L is different from that of the second sub-pixel 49U, so that a color output of the first sub-pixel 49L is difficult to be balanced with a color output of the second sub-pixel 49U in one pixel 48 in outputting white. Hereinafter, the pixel 48 at the position corresponding to the white pixel in FIG. 9 may be referred to as a "target pixel".

In this embodiment, an output is produced using the sub-pixels 49 included in the pixels 48 around the pixel 48 that outputs white. By way of example, as illustrated in FIG. 10, the following describes a case in which the target pixel is the pixel 48*a*. In this case, the sub-pixel rendering processing unit 24 included in the signal processing unit 20 performs signal processing for reproducing white using, in addition to the sub-pixels 49 included in the target pixel, the sub-pixels 49 included in the other pixel 48 adjacent to the target pixel in at least one of the row direction, the column direction, and an oblique direction. Specifically, as illustrated in FIG. 10 for example, the sub-pixel rendering processing unit 24 lights the first sub-pixel 49L of green (G) included in the pixel 48*c* on the left side of the target pixel and the first sub-pixel 49L of blue (B) included in the pixel 48*b* adjacent to the target pixel obliquely downward to the left in addition to all of the sub-pixels 49 included in the target pixel. That is, in this example, the second sub-pixel 49D of white (W) included in the target pixel outputs part of components of (R, G, B)=(255, 255, 255) indicated by the input signal through the expansion processing described above. The rest of the components of (R, G, B)=(255, 255, 255) indicated by the input signal that is not output by the second sub-pixel 49D of white (W) included in the target pixel is output by the second sub-pixel 49U of blue (B) and the first sub-pixel 49L of red (R) included in the target pixel, the first sub-pixel 49L of green (G) included in the pixel 48*c* adjacent to the left of the target pixel, and the first sub-pixel 49L of blue (B) included in the pixel 48*b* adjacent to the target pixel obliquely downward to the left. In this way, the signal processing unit 20 performs signal processing of determining the output signal to each sub-pixel 49 included in each of the pixels 48 so that the components of the input signal are distributed.

As exemplified in FIG. 10, the size of the sub-pixel 49 of blue (B) is larger than that of the sub-pixel 49 of red (R) and the sub-pixel 49 of green (G). In such a case in which the size of the sub-pixels 49 used for color reproduction is not uniform, the signal processing unit 20 determines the output signal so that intensity of light from the sub-pixel 49 having a relatively large display region is balanced with intensity of light from the sub-pixel 49 having a relatively small display region.

Specifically, in a case of the example illustrated in FIG. 10, the sub-pixel rendering processing unit 24 causes the intensity of light emitted from one of the sub-pixels 49 of blue (B) to be relatively lower than the intensity of light emitted from one of the sub-pixels 49 of red (R) and green (B) by distributing blue components for output to the second sub-pixel 49U of blue (B) included in the target pixel and the first sub-pixel 49L of blue (B) included in the pixel 48*b* adjacent to the target pixel obliquely downward to the left. More specifically, for example, assumed is a case in which the components assigned to the sub-pixel 49 of white (W) included in the target pixel from among the components of (R, G, B)=(255, 255, 255) indicated by the input signal are (R, G, B)=(127, 127, 127). In this case, the rest of the components is (R, G, B)=(128, 128, 128). The sub-pixel rendering processing unit 24 assigns (R)=(128) to the first sub-pixel 49L of red (R) included in the target pixel. The sub-pixel rendering processing unit 24 assigns (G)=(128) to the first sub-pixel 49L of green (G) included in the pixel 48*c* adjacent to the left of the target pixel. The sub-pixel rendering processing unit 24 also distributes and assigns (B)=(64) to the second sub-pixel 49U of blue (B) included in the target pixel and the first sub-pixel 49L of blue (B) included in the pixel 48*b* adjacent to the target pixel obliquely downward to the left.

As described above with reference to FIGS. 9 and 10, in outputting the color that cannot be reproduced with the sub-pixels 49 included in one pixel 48, the sub-pixel rendering processing unit 24 performs sub-pixel rendering processing using the sub-pixels 49 that are included in the other pixels 48 and required for reproducing the color. In this embodiment, when the other sub-pixels 49 are used in the sub-pixel rendering processing, the components are distributed to the sub-pixels 49 included in the other two pixels 48 adjacent to the target pixel (in the row direction, the column direction, and the oblique direction). However, the embodiment is not limited thereto. The components may be distributed and assigned to three or more adjacent pixels 48, or may be distributed to only one adjacent pixel 48. The adjacent pixel 48 is used above, but the pixel is not limited to the pixel 48 that is directly in contact with the target pixel. The components may be distributed with an interval of one or more pixels.

Figure 11:
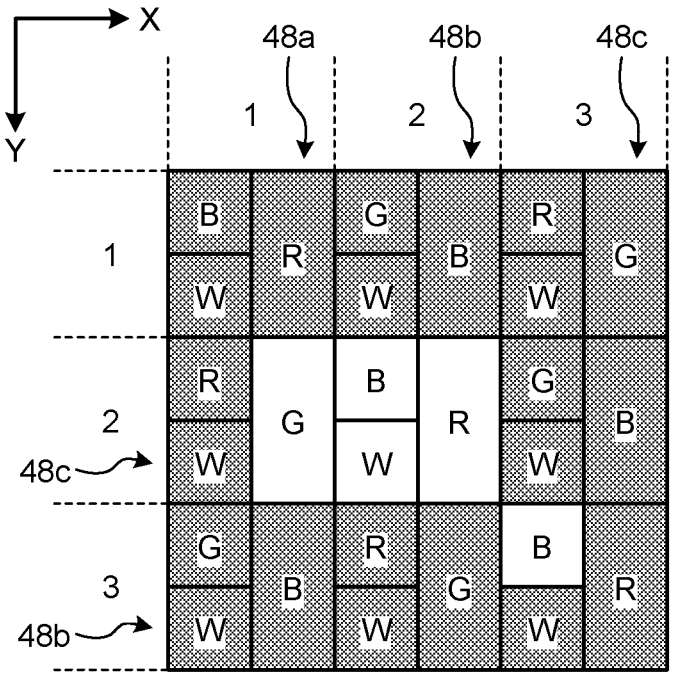
FIG. 11 is a diagram illustrating an example of the display output different from that in FIG. 10 in a case in which sub-pixel rendering processing is applied to the input signal illustrated in FIG. 9.

FIG. 11 is a diagram illustrating an example of the display output different from that in FIG. 10 in a case in which sub-pixel rendering processing is applied to the input signal illustrated in FIG. 9. The sub-pixel rendering processing unit 24 may output an output signal that produces a display output as illustrated in FIG. 11 as a processing result of the sub-pixel rendering processing based on the input signal illustrated in FIG. 9. The example illustrated in FIG. 11 is the same as that in FIG. 10 except that the blue component assigned to the first sub-pixel 49L included in the pixel 48 on the lower left side of the target pixel in the example illustrated in FIG. 10 is assigned to the second sub-pixel 49U included in the pixel 48 on the lower right side of the target pixel. In this way, in the embodiment, when the target pixel as one pixel is assigned the input signal requiring a non-selected color (for example, green (G) in FIGS. 10 and 11) that is a color other than the colors of the sub-pixels 49 included in the target pixel, the signal processing unit 20 produces an output using the other pixel 48 (for example, the pixel 48 adjacent to the target pixel) including the sub-pixel 49 including the non-selected color in the output of the target pixel. When the target pixel as one pixel is assigned an input signal requiring to output, with higher gradation, a specific color (for example, blue (B) in FIGS. 10 and 11) assigned to the second sub-pixels 49U and 49D each having a display region smaller than that of the first sub-pixel 49L among the sub-pixels 49 included in the target pixel, the signal processing unit 20 produces an output using the other pixel 48 (for example, the pixel 48 adjacent to the target pixel) including the sub-pixel 49 including the specific color in the output of the target pixel.

The sub-pixel rendering processing has been described above with reference to FIGS. 9, 10, and 11. The sub-pixel rendering processing is performed in outputting the color that cannot be reproduced with the sub-pixels 49 included in one pixel 48, not only in outputting the color corresponding to the input signal of white.

Figure 12:
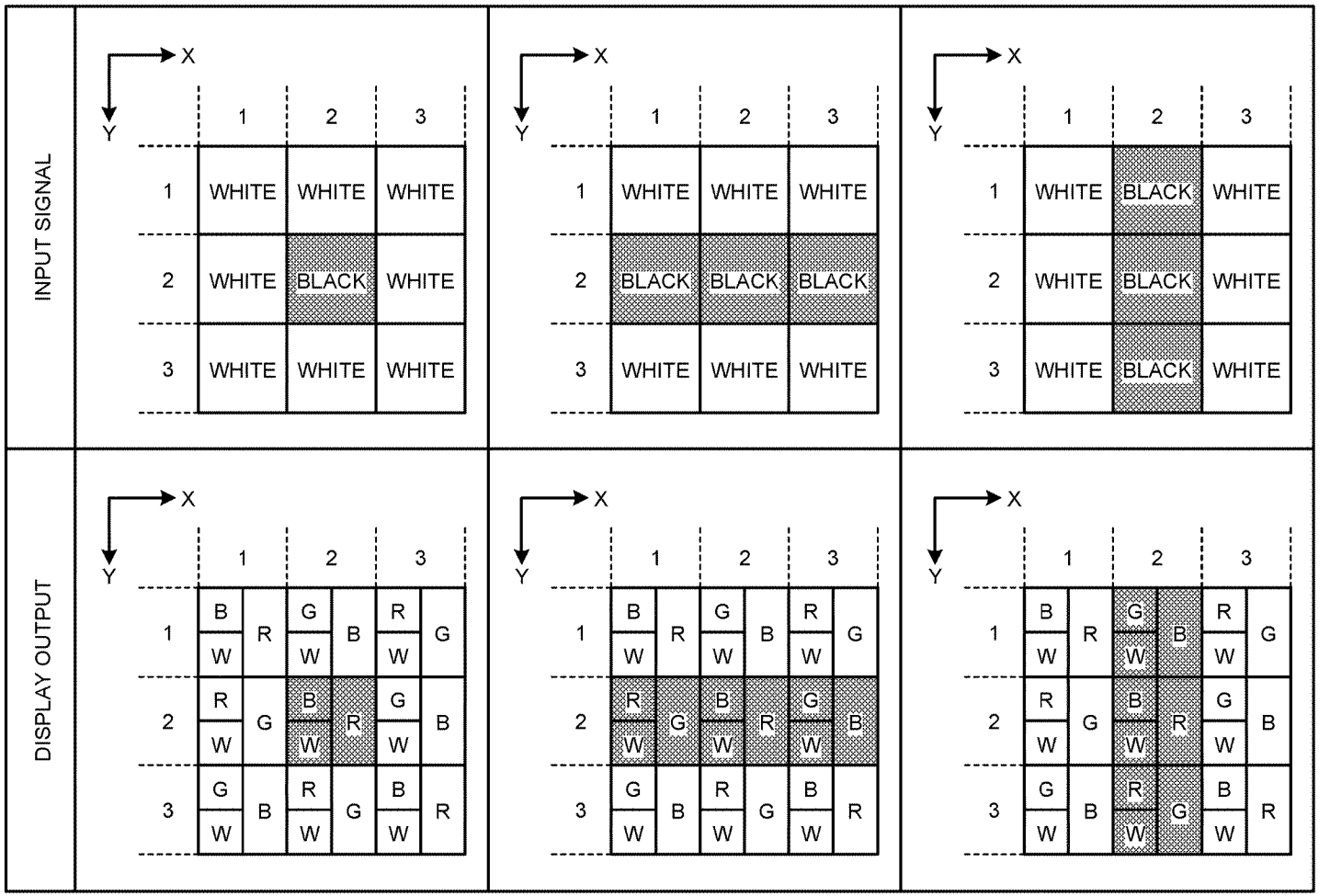
FIG. 12 is a diagram illustrating examples of the display output depending on the input signal, the examples each being different from that in FIGS. 10 and 11.

FIG. 12 is a diagram illustrating examples of the display output depending on the input signal, the examples each being different from that in FIGS. 10 and 11. As illustrated in FIG. 12, when the input signal indicating that only one pixel, one pixel row, or one pixel column is black, for example, (R, G, B)=(0, 0, 0), and the pixels around the one pixel, the one pixel row, or the one pixel column are all white, that is, (R, G, B)=(255, 255, 255), is input, the sub-pixel rendering processing unit 24 causes all of the sub-pixels 49 included in the pixels 48 at positions corresponding to the one pixel, the one pixel row, or the one pixel column to be in a non-lighting state, and causes all of the sub-pixels 49 included in the other pixels 48 to be in a lighting state. As exemplified in FIG. 12, (R, G, B)=(0, 0, 0) can be output by one pixel 48 without all of the colors used for the display output, so that the output is not necessarily distributed to the sub-pixels 49 included in the other pixels 48. FIG. 12 exemplifies a case in which only one pixel, one pixel row, or one pixel column is black, but the same applies to a black region in which 2×2 pixels or more are continuous. Further, the above can be applied to colors other than black, that is, when the color indicated by the input signal is a color that can be output with only the sub-pixels 49 included in the pixel 48 corresponding to the input signal, the output is not necessarily distributed to the sub-pixels 49 included in the other pixels 48.

The sub-pixel rendering processing unit 24 performs signal control processing to match a timing for driving the sub-pixel 49 by the scanning line SCL coupled to the sub-pixel 49 included in the pixel 48 with a timing for outputting the output signal output via the signal line DTL.

FIG. 13 is a diagram illustrating an example of a relation between output signals for the sub-pixels 49 included in each of the pixels 48 after the sub-pixel rendering processing and output signals output through the signal control processing in accordance with the timing for driving the scanning line SCL. As a specific example, FIG. 13 exemplifies signal control processing about the display region in which the number of pixels 48 in the row direction $\chi$ the column direction is represented as V×D=3×3, and the same applies to a larger display region. In FIG. 13, R(V, D) represents the output signal for the sub-pixel 49 of red (R). In FIG. 13, G(V, D) represents the output signal for the sub-pixel 49 of green (G). In FIG. 13, B(V, D) represents the output signal for the sub-pixel 49 of blue (B). In FIG. 13, W(V, D) represents the output signal for the sub-pixel 49 of white (W).

As illustrated in FIG. 13, the output signals for the first pixel row before signal control processing include R(1, D), G(1, D), B(1, D), and W(1, D) as the output signals for the sub-pixels 49 included in the pixel 48 of the first row (1, D) illustrated in FIG. 4. The output signals for the second pixel row before signal control processing include R(2, D), G(2, D), B(2, D), and W(2, D) as the output signals for the sub-pixels 49 included in the pixel 48 of the second row (2, D) illustrated in FIG. 4. The output signals for the third pixel row before signal control processing include R(3, D), G(3, D), B(3, D), and W(3, D) as the output signals for the sub-pixels 49 included in the pixel 48 of the third row (3, D)

illustrated in FIG. 4. When sub-pixel rendering processing is performed as illustrated in the example of FIG. 10, among the components of the input signal for the pixel 48 of (2, 2) as the target pixel, the component of green (G) that is not converted into white (W) is assigned to G(2, 1), and part of the component of blue (B) is assigned to B(3, 1).

As described above, among the sub-pixels 49 included in the pixel 48 of the first row (1, D), the first sub-pixel 49L and the second sub-pixel 49U are coupled to the scanning line SCL arranged on the upper side of the pixel 48, and the second sub-pixel 49D is coupled to the scanning line SCL arranged on the lower side of the pixel 48. Due to this, the sub-pixel rendering processing unit 24 matches a timing when the scanning signal is output to the scanning line Gp+1 with a timing for outputting the output signal to the first sub-pixel 49L and the second sub-pixel 49U among the sub-pixels 49 included in the pixel 48 of the first row (1, D). The sub-pixel rendering processing unit 24 matches a timing when the scanning signal is output to the scanning line Gp+2 with a timing for outputting the output signal to the second sub-pixel 49D among the sub-pixels 49 included in the pixel 48 of the first row (1, D) and outputting the output signal to the first sub-pixel 49L and the second sub-pixel 49U among the sub-pixels 49 included in the pixel 48 of the second row (2, D). The sub-pixel rendering processing unit 24 also matches a timing when the scanning signal is output to the scanning line Gp+3 with a timing for outputting the output signal to the second sub-pixel 49D among the sub-pixels 49 included in the pixel 48 of the second row (2, D) and outputting the output signal to the first sub-pixel 49L and the second sub-pixel 49U among the sub-pixels 49 included in the pixel 48 of the third row (3, D). Subsequently, the sub-pixel rendering processing unit 24 similarly matches the timing for outputting the scanning signal with the timing for outputting the output signals for the sub-pixels 49 included in the pixels 48 of the fourth and subsequent rows.

Specifically, as illustrated in FIG. 13, the sub-pixel rendering processing unit 24 matches the timing for outputting the scanning signal to the scanning line Gp+1 with the timing for outputting R(1, 1), B(1, 2), and G(1, 3) for the first sub-pixel 49L of the first row and B(1, 1), G(1, 2), and R(1, 3) for the second sub-pixel 49U of the first row among the output signals R(1, 1), B(1, 1), W(1, 1), G(1, 2), B(1, 2), W(1, 2), R(1, 3), G(1, 3), and W(1, 3) for the first pixel row. The sub-pixel rendering processing unit 24 matches the timing for outputting the scanning signal to the scanning line Gp+2 with the timing for outputting W(1, 1), W(1, 2), and W(1, 3) for the second sub-pixel 49D of the first row among the output signals for the first pixel row, and matches the timing for outputting the scanning signal to the scanning line Gp+2 with the timing for outputting G(2, 1), R(2, 2), and B(2, 3) for the first sub-pixel 49L of the second row and R(2, 1), B(2, 2), and G(2, 3) for the second sub-pixel 49U of the second row among the output signals R(2, 1), G(2, 1), W(2, 1), R(2, 2), B(2, 2), W(2, 2), G(2, 3), B(2, 3), and W(2, 3) for the second pixel row. The sub-pixel rendering processing unit 24 also matches the timing for outputting the scanning signal to the scanning line Gp+3 with the timing for outputting W(2, 1), W(2, 2), and W(2, 3) for the second sub-pixel 49D of the second row among the output signals for the second pixel row, and matches the timing for outputting the scanning signal to the scanning line Gp+3 with the timing for outputting B(3, 1), G(3, 2), and R(3, 3) for the first sub-pixel 49L of the third row and G(3, 1), R(3, 2), and B(3, 3) for the second sub-pixel 49U of the third row among the output signals G(3, 1), B(3, 1), W(3, 1), R(3, 2), G(3, 2), W(3, 2), R(3, 3), B(3, 3), and W(3, 3) for the third pixel row. Subsequently, the sub-pixel rendering processing unit 24 similarly performs signal control processing according to a coupling relation between the scanning line SCL and the sub-pixel 49 for the fourth and subsequent rows.

When the target pixel is the pixel 48 at coordinates of (2, 2) and the sub-pixel rendering processing illustrated in FIG. 10 is performed thereon, the components corresponding to the input signal of white in FIG. 9 are assigned to G(2, 1) and B(3, 1) in addition to B(2, 2), W(2, 2), and R(2, 2). When the target pixel is the pixel 48 at the coordinates of (2, 2) and the sub-pixel rendering processing illustrated in FIG. 11 is performed thereon, the components corresponding to the input signal of white in FIG. 9 are assigned to G(2, 1) and B(3, 3) in addition to B(2, 2), W(2, 2), and R(2, 2).

The sub-pixel 49 used for outputting the color that cannot be reproduced with the sub-pixels 49 included in one pixel 48 in the sub-pixel rendering processing may be determined based on the coupling relation between the sub-pixel 49 and the scanning line SCL. In this embodiment, as the sub-pixel 49 used for outputting the color that cannot be reproduced with the sub-pixels 49 included in one pixel 48, preferentially used are the sub-pixel 49 sharing the scanning line SCL with the sub-pixel 49 included in the one pixel 48, and the sub-pixel 49 coupled to the scanning line SCL that is arranged on a lower side than the scanning line SCL coupled to the sub-pixel 49 included in the one pixel 48. Accordingly, in determining the output signal for the sub-pixel 49 included in the pixel 48 in each row, the color indicated by the input signal for the pixel 48 in the next row is not required to be considered, so that the processing can be simplified. As the sub-pixel 49 used for outputting the color that cannot be reproduced with the sub-pixels 49 included in one pixel 48, the sub-pixel 49 coupled to the scanning line SCL that is arranged on an upper side than the scanning line SCL coupled to the sub-pixel 49 included in the one pixel 48 may be used. For example, regarding the output by the pixel 48 in the lowermost row, it may be considered to perform color reproduction using the sub-pixel 49 included in the pixel 48 in an upper row than the lowermost row in addition to the sub-pixel 49 included in the pixel 48 in the lowermost row.

Figure 14:
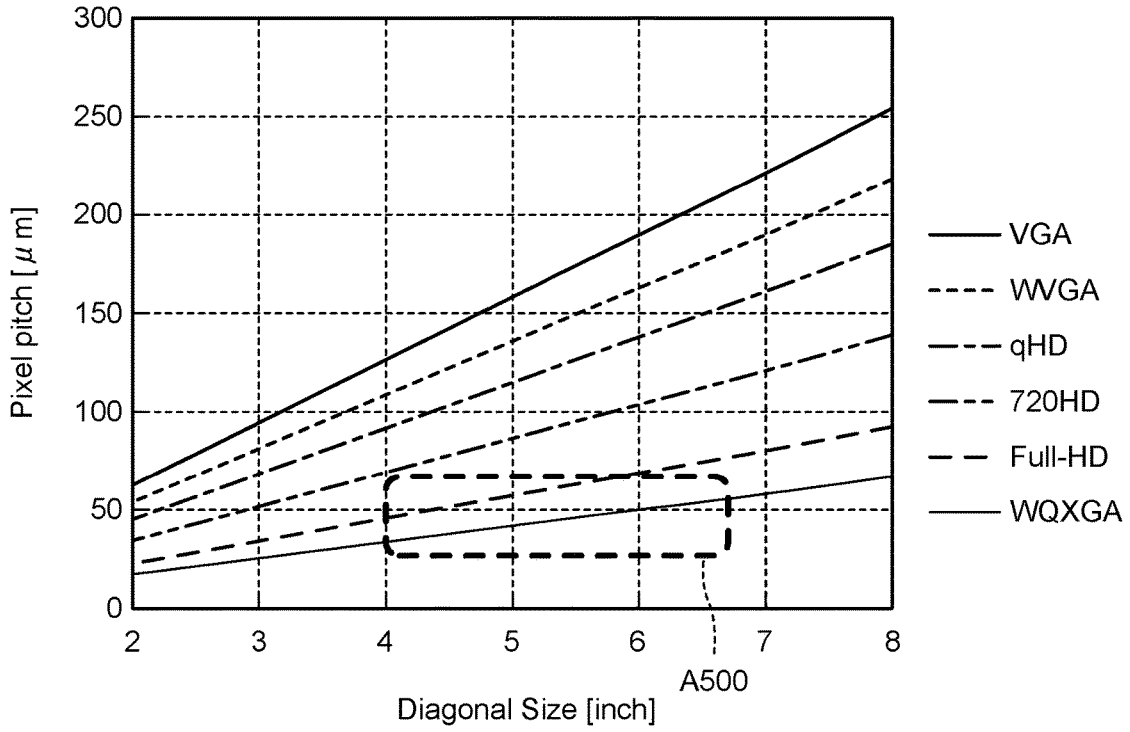
FIG. 14 is an explanatory diagram illustrating a relation between resolution and a diagonal length of the sub-pixel.
Figure 15:
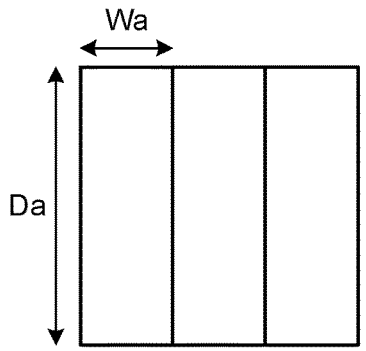
FIG.15 RELATED ART
FIG. 15 is an explanatory diagram for illustrating a size of a pixel according to a first comparative example.
Figure 16:
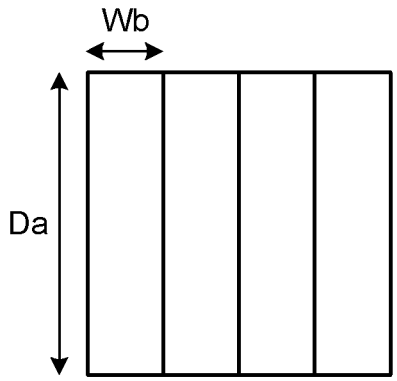
FIG.16 RELATED ART
FIG. 16 is an explanatory diagram for illustrating a size of a pixel according to a second comparative example.
Figure 17:
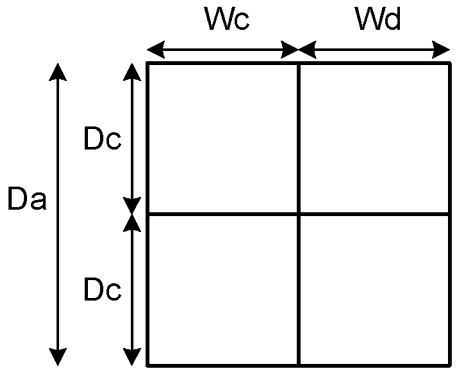
FIG.17 RELATED ART
FIG. 17 is an explanatory diagram for illustrating a size of a pixel according to a third comparative example.
Figure 18:
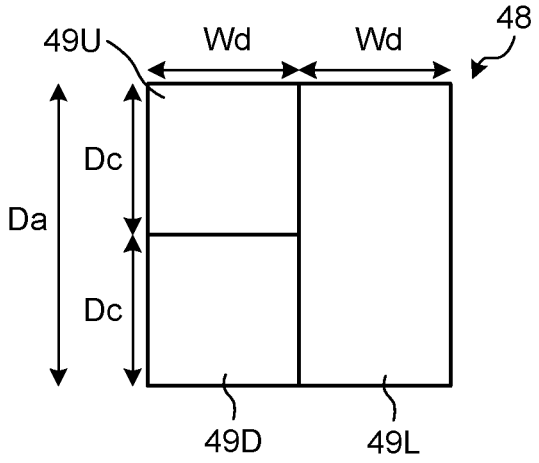
FIG. 18 is an explanatory diagram for illustrating the size of the pixel according to the embodiment.

FIG. 14 is an explanatory diagram illustrating a relation between resolution and a diagonal length of the sub-pixel. The vertical axis indicates the resolution, the horizontal axis indicates the diagonal length of the sub-pixel, and a region of 500 ppi (the number of pixels per inch: pixel per inch) is represented as A500. FIG. 15 is an explanatory diagram for illustrating the arrangement and the size of the sub-pixel according to a first comparative example. FIG. 16 is an explanatory diagram for illustrating the arrangement and the size of the sub-pixel according to a second comparative example. FIG. 17 is an explanatory diagram for illustrating the arrangement and the size of the sub-pixel according to a third comparative example. FIG. 18 is an explanatory diagram for illustrating the arrangement and the size of the sub-pixel according to this embodiment. An aperture area WbxDa in the pixel including four sub-pixels illustrated in FIG. 16 is smaller than the aperture area WaxDa of the sub-pixel in the pixel including three sub-pixels illustrated in FIG. 15 for the same area of 500 ppi. When pixel density is increased, a high aperture ratio of the pixel according to the second comparative example illustrated in FIG. 16 is difficult to secure as compared with the pixel according to the first comparative example illustrated in FIG. 15.

The pixel illustrated in FIG. 17 can be driven by increasing the number of signal lines DTL without increasing the number of scanning lines SCL. However, the pixel illustrated in FIG. 17 requires a larger number of signal lines DTL than that of the pixel 48 according to the embodiment, so that the signal line DTL overlaps the display region of the sub-pixel. Due to this, the effective display region of the sub-pixel is reduced by the region that the signal line DTL overlaps, so that the aperture ratio is lowered. The increase in the number of signal lines DTL increases the scale of the signal output circuit, which is not preferable. On the other hand, the pixel illustrated in FIG. 17 can be driven by increasing the number of scanning lines SCL without increasing the number of signal lines DTL. In this case, a driving frequency is increased (for example, by two times), so that power consumption tends to be increased.

As illustrated in FIG. 18, in the pixel 48 according to the embodiment, the two second sub-pixels 49U and 49D are aligned in the column direction, and the two second sub-pixels 49U and 49D and the first sub-pixel 49L are aligned in the row direction as described above. Accordingly, the aperture area of each of the two second sub-pixels 49U and 49D is Dc×Wd, and the aperture area of the first sub-pixel 49L is Da×Wd. The black matrix that divides the sub-pixel 49 into a plurality of pieces in the column direction is not provided to the first sub-pixel 49L, so that a higher aperture ratio can be secured. The pixel 48 according to the embodiment can suppress the increase in the number of scanning lines SCL, so that the driving frequency can be suppressed. The increase in the number of signal lines DTL can be limited to one signal line DTL arranged to overlap the first sub-pixel 49L. Accordingly, the display device 10 according to the embodiment can achieve both of low power consumption and a higher aperture ratio.

According to the embodiment, in the display device 10 that produces a display output corresponding to the input signal and combines the display output corresponding to each of four colors, the image display panel 30 includes a plurality of pixels 48 each including three sub-pixels 49 the number of which is smaller than the number of colors, the pixel 48 includes the one first sub-pixel 49L having the largest display region among the sub-pixels 49 and the two second sub-pixels 49U and 49D each having the display region smaller than that of the first sub-pixel 49L. Accordingly, as compared with the display device in the related art to which the sub-pixel of white (W) is simply added, a higher aperture ratio can be secured because of the larger display region of the first sub-pixel 49L. According to the embodiment, the sub-pixels 49 included in one pixel 48 output different colors, and one of the second sub-pixels 49U and 49D outputs the high luminance color having the highest luminance (for example, white (W)) among the four or more colors. Thus, one pixel 48 necessarily includes the sub-pixel 49 of high luminance color by which higher luminance can be easily secured, so that higher resolution can be obtained in the display output. The sub-pixels 49 included in one pixel 48 output different colors and the color of one of the second sub-pixels 49U and 49D is a high luminance color, so that the color of the first sub-pixel 49L is necessarily a color other than the high luminance color. Accordingly, a color other than the high luminance color, that is, a color that contributes to color reproduction more greatly than the high luminance color in the display output can be arranged in the first sub-pixel 49L having a higher aperture ratio, so that the aperture ratio of the color other than the high luminance color can be increased in the display region of the image display panel 30. Thus, the high luminance color is arranged in each of the pixels 48 and a high aperture ratio of the sub-pixel 49 of a color other than the high luminance color can be easily secured, so that the high luminance color can be easily balanced with the color other than the high luminance color.

Combinations of the colors of the sub-pixels 49 are different among adjacent pixels 48, and the color arrangement of the sub-pixels 49 is periodically repeated in units of a predetermined number of pixels (for example, three pixels 48). Accordingly, colors used for the display output can be uniformly distributed and arranged in the display region of the image display panel 30.

The two second sub-pixels 49U and 49D are aligned in one of the row direction and the column direction, and the two second sub-pixels 49U and 49D and the first sub-pixel 49L are aligned in the other one of the row direction and the column direction. Due to this, a wide aperture width of each of the second sub-pixels 49U and 49D in the row and column directions can be secured, and the aperture width of the first sub-pixel 49L along one direction can be increased. Accordingly, a wide aperture width of the sub-pixel 49 can be easily secured when the aperture of one sub-pixel 49 is reduced due to enhanced resolution.

The signal line of the first sub-pixel 49L is arranged at a position overlapping the display region of the first sub-pixel 49L. Due to this, the signal line can be provided without narrowing the effective display region of each of the second sub-pixels 49U and 49D the display region of which is relatively smaller than that of the first sub-pixel 49L, which makes influence of the signal line be smaller in the display output.

In outputting the color that cannot be reproduced with the sub-pixels 49 included in one pixel 48, the signal processing unit 20 produces an output using the sub-pixel 49 that is included in the other pixel 48 and required for reproducing the color. Specifically, for example, when one pixel (for example, the target pixel) is assigned an input signal requiring a non-selected color that is a color other than the colors of the sub-pixels 49 included in the one pixel 48, the signal processing unit 20 produces an output using another pixel 48 (for example, a pixel 48 adjacent to the target pixel) including a sub-pixel 49 that includes the non-selected color in the output of the one pixel. Accordingly, even when the number of the sub-pixels 49 included in one pixel 48 is smaller than the number of colors, the display output can be produced by complementing color components corresponding to the input signal with the entire image display panel 30.

When one pixel (for example, the target pixel) is assigned an input signal requiring that a specific color assigned to each of the second sub-pixels 49U and 49D having the display region smaller than that of the first sub-pixel 49L among the sub-pixels 49 included in the one pixel 48 is output with higher gradation, the signal processing unit 20 produces an output using another pixel (for example, a pixel 48 adjacent to the target pixel) including a sub-pixel 49 that includes the specific color in the output of the one pixel. Accordingly, for example, when the target pixel is assigned the input signal requiring to output high luminance that is output luminance for color reproduction of the color assigned to the second sub-pixel 49U or the second sub-pixel 49D included in the target pixel and is difficult to secure with only the display region of the second sub-pixel 49U or the second sub-pixel 49D, the high luminance can be output using the sub-pixel 49 included in another pixel 48.

According to the embodiment, the second sub-pixel 49D of white (W) is necessarily adjacent to the first sub-pixel 49L in the row direction, so that the viewing angle color mixing phenomenon can be prevented from being caused by light leakage in the region in which the second sub-pixel 49D is arranged in the row direction.

Modification

Next, the following describes modifications of the embodiment of the present invention. In the description of the modifications, the same component as that in the embodiment described above may be denoted by the same reference numeral, and the description thereof will not be repeated in some cases.

In the above embodiment, the combinations of colors of the sub-pixels 49 included in each of the adjacent pixels 48 are different from each other in the row direction and the column direction. Alternatively, the combinations of colors of the sub-pixels 49 included in each of the adjacent pixels 48 may be different from each other in one of the row direction and the column direction. The following describes a first modification and a second modification of the embodiment of the present invention with reference to FIGS. 19 and 20.

First Modification

Figure 19:
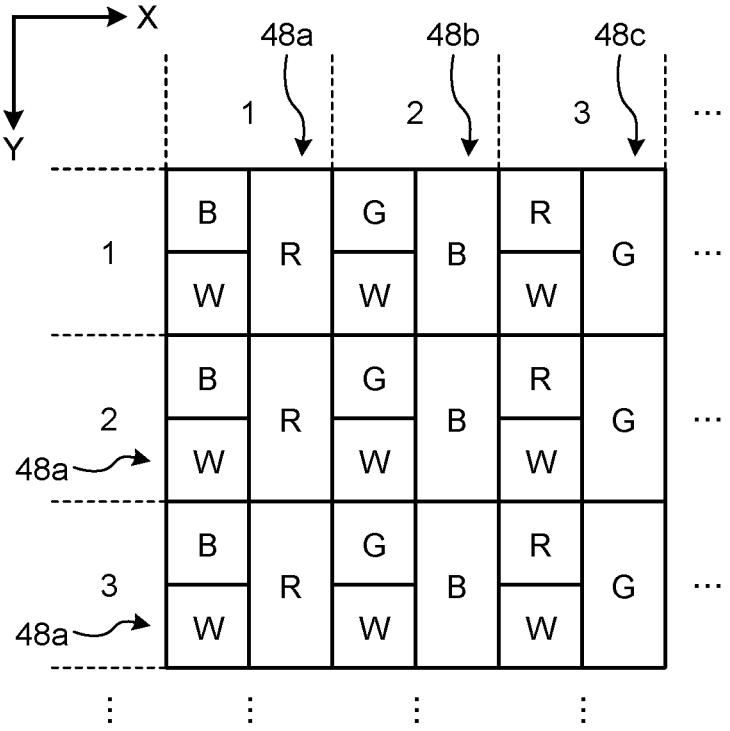
FIG. 19 is a diagram illustrating an example of an arrangement of colors of sub-pixels included in a plurality of pixels arranged in a row direction and a column direction according to a first modification.

FIG. 19 is a diagram illustrating an example of the arrangement of colors of the sub-pixels 49 included in a plurality of pixels 48 arranged in the row and column directions according to the first modification. As illustrated in FIG. 19, the combinations of colors of the sub-pixels 49 included in each of the adjacent pixels 48 may be different from each other in the row direction, and the combinations of colors of the sub-pixels 49 included in each of the adjacent pixels 48 may be the same in the column direction. In FIG. 19, the pixels 48 are repeatedly and periodically arranged in units of three pixels in order of the pixel 48*a*, the pixel 48*b*, and the pixel 48*c* from the left in all of the rows, but the order of arrangement of the pixel 48*a*, the pixel 48*b*, and the pixel 48*c* can be appropriately modified.

Second Modification

Figure 20:
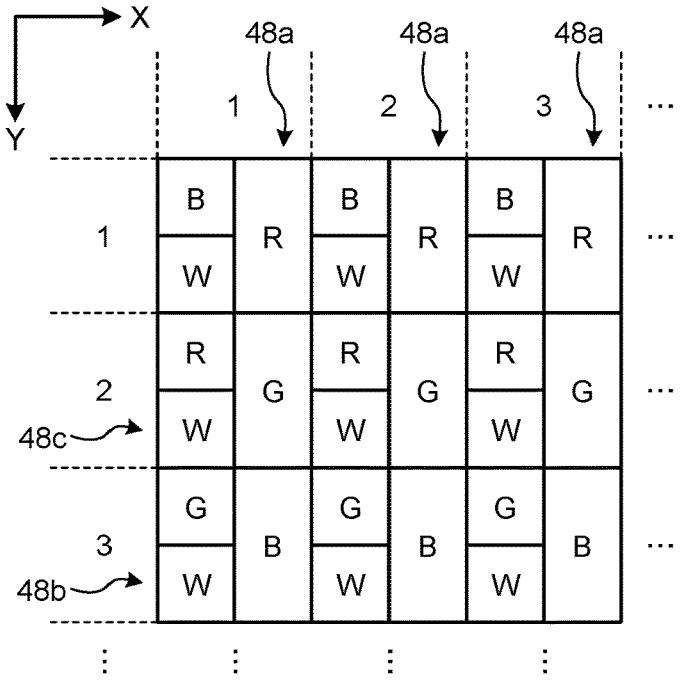
FIG. 20 is a diagram illustrating an example of an arrangement of colors of sub-pixels included in a plurality of pixels arranged in a row direction and a column according to a second modification.

FIG. 20 is a diagram illustrating an example of the arrangement of colors of the sub-pixels 49 included in a plurality of pixels 48 arranged in the row and column directions according to the second modification. As illustrated in FIG. 20, the combinations of colors of the sub-pixels 49 included in each of the adjacent pixels 48 may be different from each other in the column direction, and the combinations of colors of the sub-pixels 49 included in each of the adjacent pixels 48 may be the same in the row direction. In FIG. 20, the pixels 48 are repeatedly and periodically arranged in units of three pixels in order of the pixel 48*a*, the pixel 48*c*, and the pixel 48*b* from the top in all of the columns, but the order of arrangement of the pixel 48*a*, the pixel 48*b*, and the pixel 48*c* can be appropriately modified.

In the first modification and the second modification, the color of the first sub-pixel 49L and the color of the second sub-pixel 49U are unified in a direction in which the combinations of colors of the sub-pixels 49 included in each of the adjacent pixels 48 are the same, but the colors are not necessarily unified. That is, the color of the first sub-pixel 49L and the color of the second sub-pixel 49U may be replaced with each other in a predetermined cycle. As a specific example, the color of the first sub-pixel 49L may be replaced with the color of the second sub-pixel 49U in odd rows or even rows in FIG. 19. In FIG. 20, the color of the first sub-pixel 49L may be replaced with the color of the second sub-pixel 49U in odd columns or even columns.

The combination of the first color, the second color, the third color, and the fourth color is the combination of red (R), green (G), blue (B), and white (W) in the embodiment described above. However, the embodiment is not limited thereto. The following describes a third modification and a fourth modification of the embodiment of the present invention with reference to FIGS. 21 and 22.

Third Modification

Figure 21:
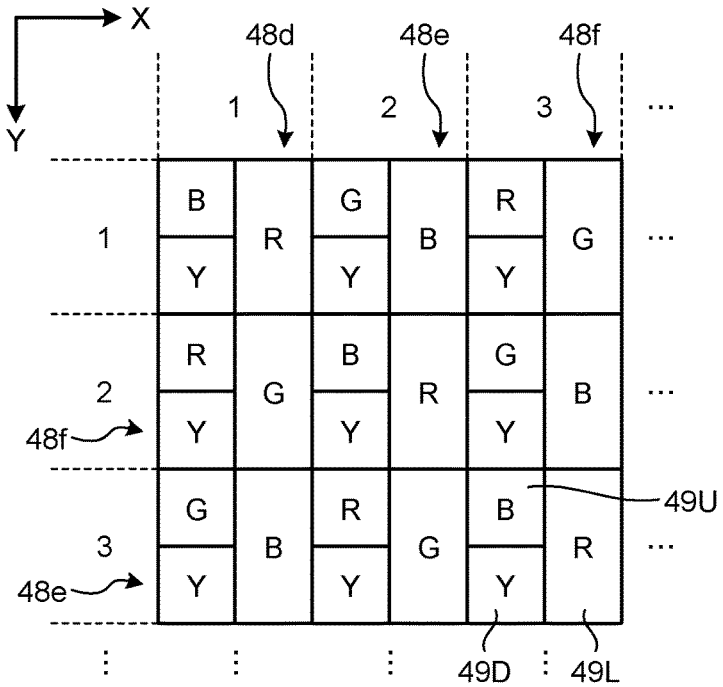
FIG. 21 is a diagram illustrating colors of sub-pixels included in pixels according to a third modification.

FIG. 21 is a diagram illustrating the colors of the sub-pixels 49 included in the pixels 48 according to the third modification. As illustrated in FIG. 21, the fourth color as a color having relatively higher luminance than that of the first color, the second color, and the third color may be yellow (Y).

In the image display panel 30 according to the third modification illustrated in FIG. 21, a pixel 48*d* including the second sub-pixel 49U of blue (B), the second sub-pixel 49D of yellow (Y), and the first sub-pixel 49L of red (R), a pixel 48*e* including the second sub-pixel 49U of green (G), the second sub-pixel 49D of yellow (Y), and the first sub-pixel 49L of blue (B), and a pixel 48*f* including the second sub-pixel 49U of red (R), the second sub-pixel 49D of yellow (Y), and the first sub-pixel 49L of green (G) are repeatedly and periodically arranged in units of three pixels along the row direction. The arrangement order of the pixel 48*d*, the pixel 48*e*, and the pixel 48*f* according to the third modification is not limited to the example illustrated in FIG. 21, and can be appropriately modified. In the example illustrated in FIG. 21, yellow (Y) is arranged in the second sub-pixel 49D. Alternatively, the color of the second sub-pixel 49U may be replaced with the color of the second sub-pixel 49D. The fourth color as the high luminance color may be cyan (C) in place of yellow (Y).

Fourth Modification

Figure 22:
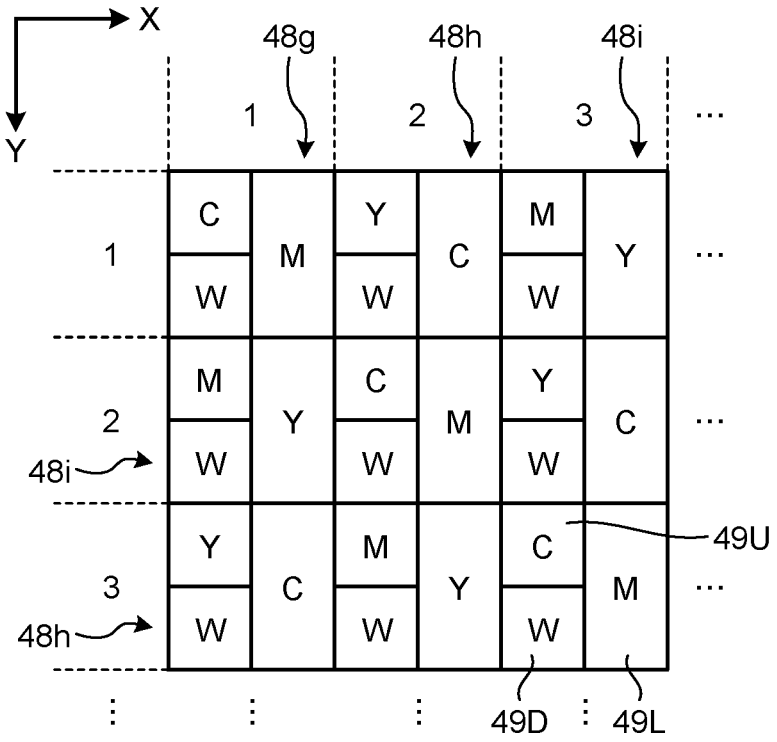
FIG. 22 is a diagram illustrating colors of sub-pixels included in pixels according to a fourth modification.

FIG. 22 is a diagram illustrating the colors of the sub-pixels 49 included in the pixels 48 according to the fourth modification. As illustrated in FIG. 22, the combination of the first color, the second color, the third color, and the fourth color may be a combination of cyan (C), magenta (M), yellow (Y), and white (W). In this case, the high luminance color is white (W).

In the image display panel 30 according to the fourth modification illustrated in FIG. 22, a pixel 48*g* including the second sub-pixel 49U of cyan (C), the second sub-pixel 49D of white (W), and the first sub-pixel 49L of magenta (M), a pixel 48*h* including the second sub-pixel 49U of yellow (Y), the second sub-pixel 49D of white (W), and the first sub-pixel 49L of cyan (C), and a pixel 48*i* including the second sub-pixel 49U of magenta (M), the second sub-pixel 49D of white (W), and the first sub-pixel 49L of yellow (Y) are repeatedly and periodically arranged in units of three pixels along the row direction. The arrangement order of the pixel 48*g*, the pixel 48*h*, and the pixel 48*i* according to the fourth modification is not limited to the example illustrated in FIG. 22, and can be appropriately modified. In the example illustrated in FIG. 22, white (W) is arranged in the second sub-pixel 49D. Alternatively, the color of the second sub-pixel 49U may be replaced with the color of the second sub-pixel 49D.

In the embodiment described above, the number of colors is four. Alternatively, the number of colors may be five or more. The following describes a fifth modification of the embodiment of the present invention with reference to FIG. 23.

Fifth Modification

Figure 23:
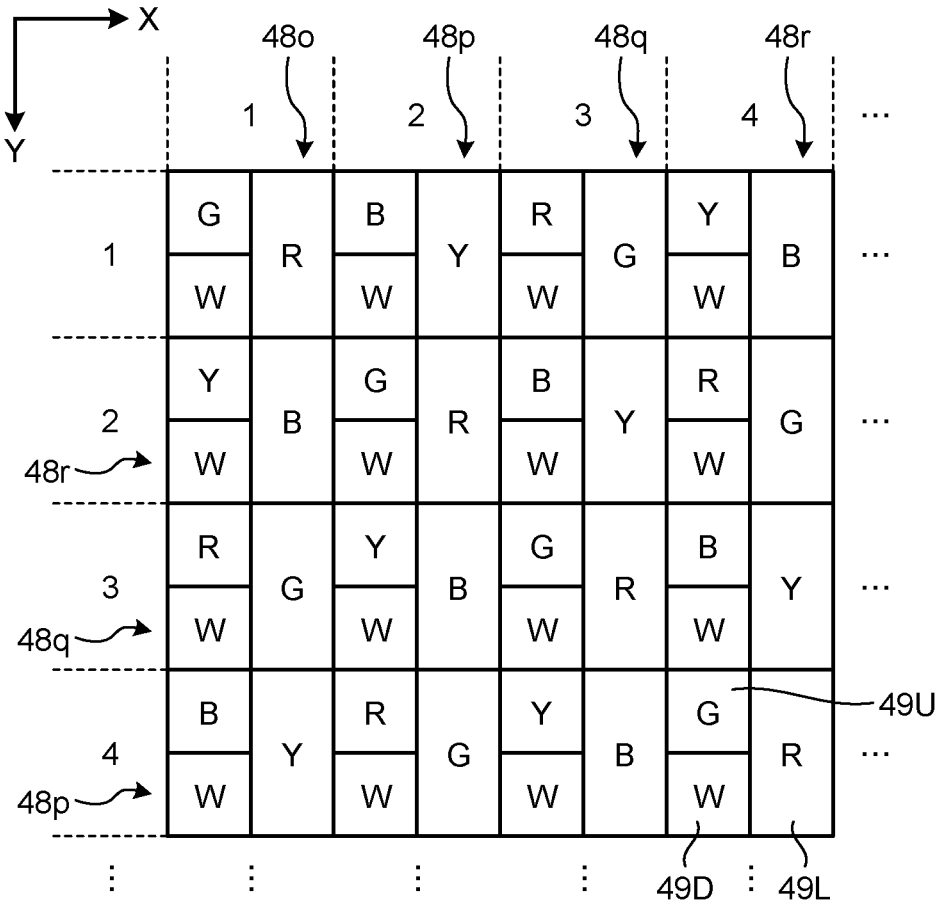
FIG. 23 is a diagram illustrating colors of sub-pixels included in pixels according to a fifth modification.

FIG. 23 is a diagram illustrating the colors of the sub-pixels 49 included in the pixels 48 according to the fifth modification. The number of colors may be five as illustrated in FIG. 23. When the number of colors is five and the number of the sub-pixels 49 included in the pixel 48 is three similarly to the embodiment described above, as illustrated in FIG. 23, the pixels 48 are repeatedly and periodically arranged in units of four pixels in a direction in which the combinations of colors of the sub-pixels 49 included in each of the adjacent pixels 48 are different from each other.

In the image display panel 30 according to the fifth modification illustrated in FIG. 23, a pixel $\mathbf{48}_o$ including the second sub-pixel 49U of green (G) and the first sub-pixel 49L of red (R), a pixel $\mathbf{48}_p$ including the second sub-pixel 49U of blue (B) and the first sub-pixel 49L of yellow (Y), a pixel $\mathbf{48}_q$ including the second sub-pixel 49U of red (R) and the first sub-pixel 49L of green (G), and a pixel $\mathbf{48}_r$ including the second sub-pixel 49U of yellow (Y) and the first sub-pixel 49L of blue (B) are repeatedly and periodically arranged in units of four pixels along the row direction. The arrangement order of the pixel $\mathbf{48}_o$, the pixel $\mathbf{48}_p$, the pixel $\mathbf{48}_q$, and the pixel $\mathbf{48}_r$ according to the fifth modification is not limited to the example illustrated in FIG. 23, and can be appropriately modified. In the example illustrated in FIG. 23, white (W) as the high luminance color is arranged in the second sub-pixel 49D. Alternatively, the color of the second sub-pixel 49U may be replaced with the color of the second sub-pixel 49D. When the color to be included in one pixel is selected from among the colors excluding the color having the highest luminance, the color is preferably selected to balance the luminance based on light emission quantity and a sensitivity ratio. More specifically, excluding the color having the highest luminance (white (W)), the first color having the highest luminance (yellow (Y)) and the second color having the lowest luminance (blue (B)) are selected, and the third color having the second highest luminance (green (G)) and the fourth color having the second lowest luminance (red (R)) are selected to reduce a luminance difference between the pixels, luminance unevenness, and the like.

In the example illustrated in FIG. 23, the combination of the first color, the second color, the third color, the fourth color, and a fifth color is a combination of red (R), green (G), blue (B), yellow (Y), and white (W). Alternatively, another combination of colors may be employed such that yellow (Y) is replaced with cyan (C) or magenta (M).

The number of colors may be an arbitrary number (ω) equal to or larger than six. When the number of colors is ω and the colors of the sub-pixels 49 are arranged so that the combinations of colors of the sub-pixels 49 included in each of the adjacent pixels 48 are different in at least one of the row direction and the column direction, the pixels 48 are repeatedly and periodically arranged in units of (ω−1) pixels in a direction in which the combinations of colors of the sub-pixels 49 included in each of the adjacent pixels 48 are different from each other.

In the embodiment described above, the areas of the display regions of the two second sub-pixels 49U and 49D are the same. Alternatively, the areas of the display regions of the two second sub-pixels 49U and 49D may be different. The following describes a sixth modification and a seventh modification of the embodiment of the present invention with reference to FIGS. 24 and 25.

Sixth Modification

Figure 24:
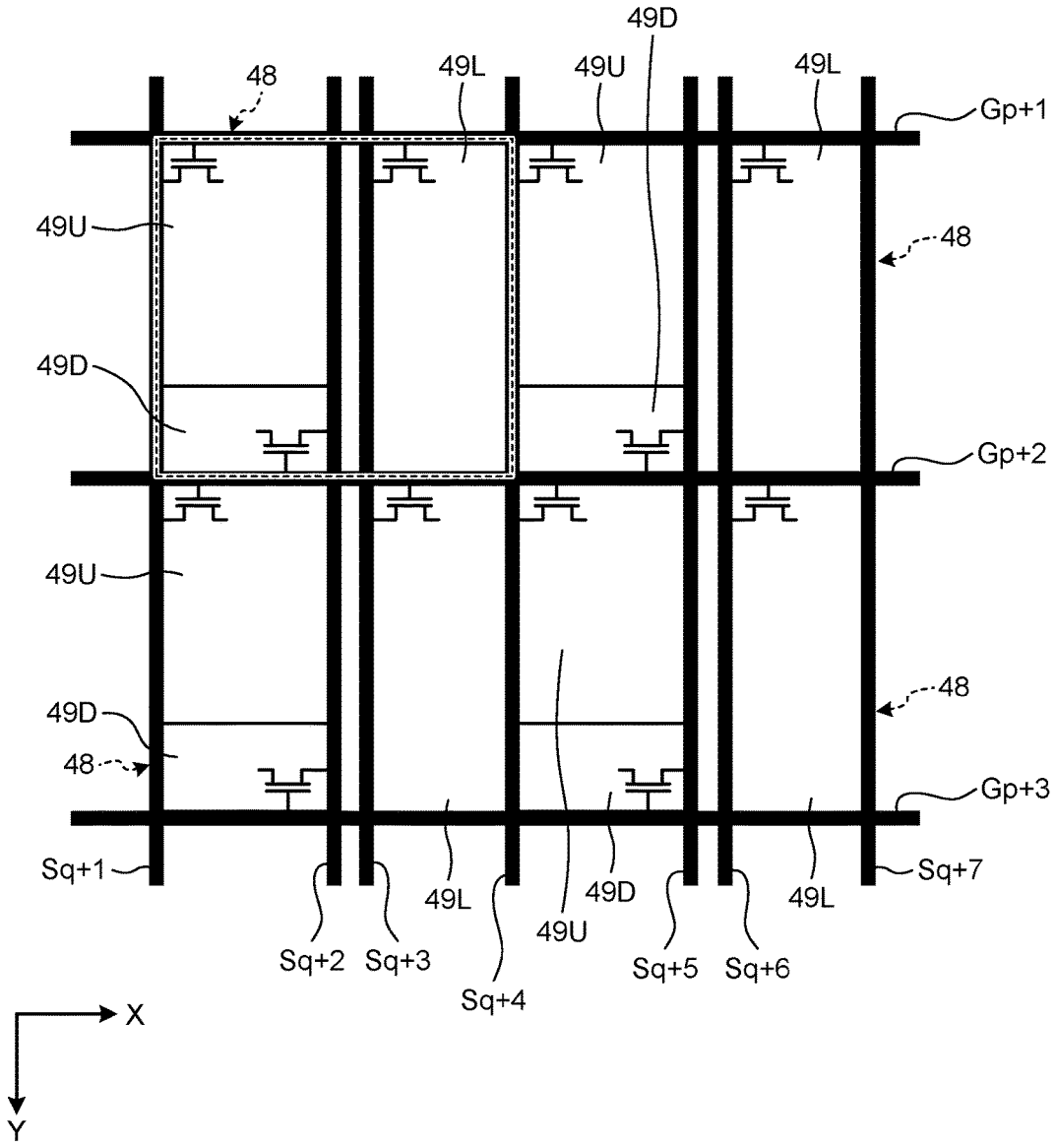
FIG. 24 is a diagram illustrating an array of pixels and sub-pixels in an image display panel according to a sixth modification.

FIG. 24 is a diagram illustrating the array of the pixels 48 and the sub-pixels 49 in the image display panel according to the sixth modification. As illustrated in FIG. 24, the second sub-pixel 49U may have a larger display region than that of the second sub-pixel 49D.

Seventh Modification

Figure 25:
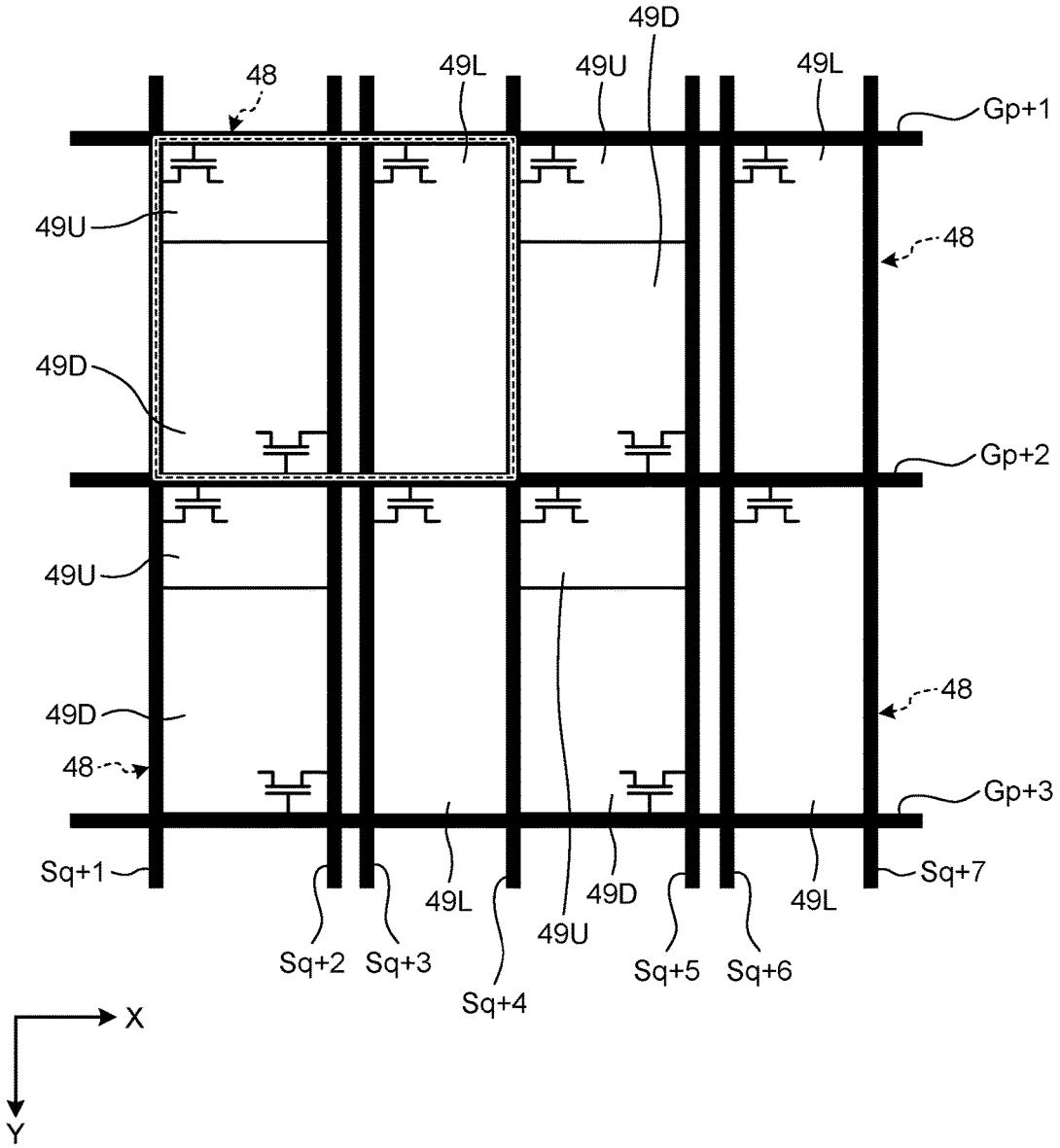
FIG. 25 is a diagram illustrating an array of pixels and sub-pixels in an image display panel according to a seventh modification.

FIG. 25 is a diagram illustrating the array of the pixels 48 and the sub-pixels 49 in the image display panel according to the seventh modification. As illustrated in FIG. 25, the second sub-pixel 49D may have a larger display region than that of the second sub-pixel 49U.

As described in the sixth modification and the seventh modification, according to the present invention, a proportion of the high luminance color in the display region can be easily changed by changing the size of the second sub-pixel 49D in which the high luminance color (for example, white (W)) is arranged. Even when the proportion of the high luminance color is changed, balance between the colors other than the high luminance color is not changed. This is because, as exemplified in FIG. 4, assuming that the number of the first sub-pixels 49L is balanced with the number of the second sub-pixels 49U included in each color, the balance between the colors other than the high luminance color is not changed as a whole in the display region including a plurality of pixels 48 even if the area of the second sub-pixel 49U is changed corresponding to a change of the area of the high luminance color arranged in the second sub-pixel 49D.

According to the embodiment, the sixth modification, and the seventh modification, the high luminance color (for example, white (W)) is arranged in the second sub-pixel 49D. Alternatively, the high luminance color may be arranged in the second sub-pixel 49U.

In the present invention, the arrangement of the signal line can be changed. When the signal line of the first sub-pixel 49L is arranged at a position overlapping the display region of the first sub-pixel 49L, high transmittance of the second sub-pixels 49U and 49D can be easily secured. The following describes an eighth modification of the embodiment of the present invention with reference to FIG. 26.

Eighth Modification

Figure 26:
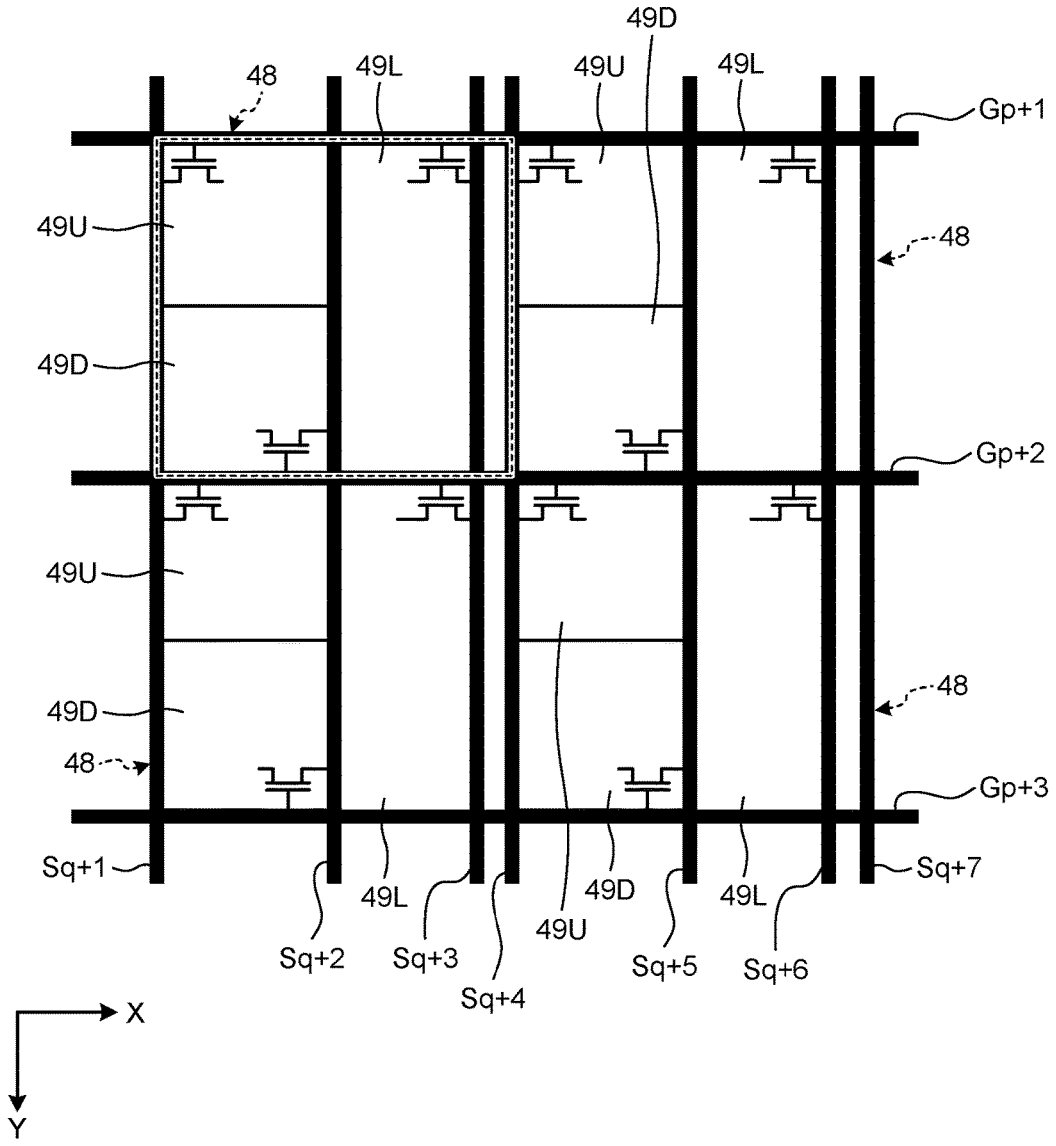
FIG. 26 is a diagram illustrating an array of pixels and sub-pixels in an image display panel according to an eighth modification.

FIG. 26 is a diagram illustrating the array of the pixels 48 and the sub-pixels 49 in the image display panel according to the eighth modification. In the embodiment described above, the signal line of the first sub-pixel 49L is arranged to traverse a leftward position in the display region of the first sub-pixel 49L along one direction (for example, the column direction). Alternatively, the signal line may be arranged to traverse a rightward position in the display region of the first sub-pixel 49L along one direction as illustrated in FIG. 26.

In the above embodiment, the two second sub-pixels 49U and 49D are aligned in any one of the row direction and the column direction, and the two second sub-pixels 49U and 49D aligned in one direction and the first sub-pixel 49L are aligned in the other one of the row direction and the column direction. However, this is merely an arrangement example of the sub-pixels 49, and the embodiment is not limited thereto. The following describes a ninth modification of the embodiment of the present invention with reference to FIG. 27.

Ninth Modification

Figure 27:
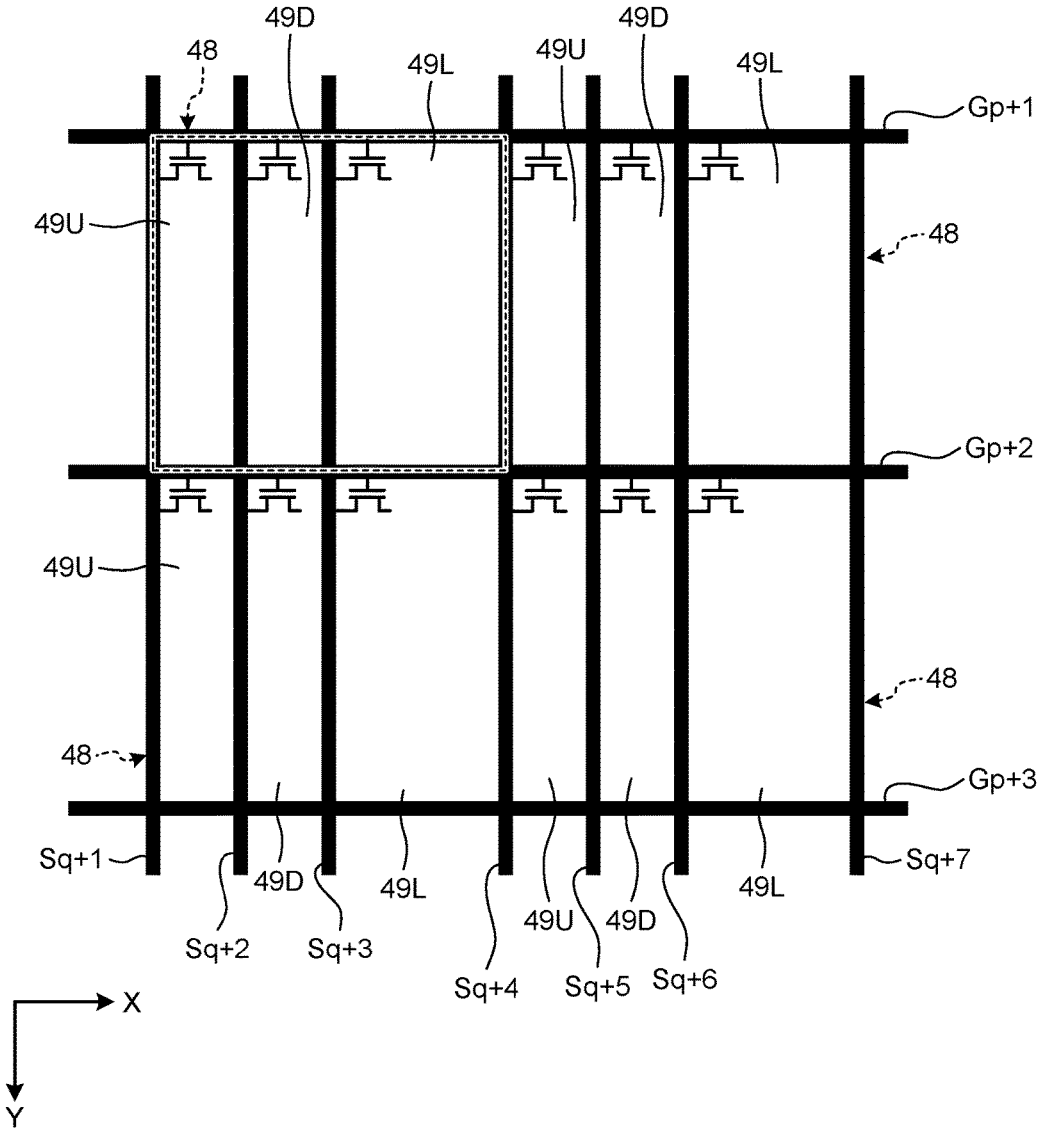
FIG. 27 is a diagram illustrating an array of pixels and sub-pixels in an image display panel according to a ninth modification.

FIG. 27 is a diagram illustrating the array of the pixels 48 and the sub-pixels 49 in the image display panel according to the ninth modification. The two second sub-pixels 49U and 49D and the first sub-pixel 49L may be aligned in one of the row direction and the column direction. Specifically, the two second sub-pixels 49U and 49D aligned along the column direction in FIG. 3 may be aligned along the row direction as illustrated in FIG. 27. That is, as illustrated in FIG. 27, the first sub-pixel 49L having the largest display region among the sub-pixels 49 and the two second sub-pixels 49U and 49D may be aligned in one direction (for example, the row direction), the second sub-pixels 49U and 49D being arranged so as to divide the display region that is substantially the same as that of the first sub-pixel 49L in two. In FIG. 27, the first sub-pixel 49L and the two second sub-pixels 49U and 49D are aligned in the row direction. Alternatively, they may be aligned in the column direction.

According to the ninth modification, all of the signal lines DTL can overlap the black matrixes partitioning the sub-pixels 49, so that a large effective display region of the first sub-pixel 49L can be easily secured as compared with the case in which the signal line of the first sub-pixel 49L overlaps the display region of the first sub-pixel 49L. All of the sub-pixels 49 included in one pixel 48 can be coupled to the same scanning line SCL. According to the ninth modification, similarly to the sixth modification and the seventh modification that have been described with reference to FIGS. 24 and 25, the area of the high luminance color can be adjusted without losing the balance between the colors other than the color assigned to the sub-pixel 49 having high luminance in the display region of the image display panel 30 by shifting a boundary between the second sub-pixels 49U and 49D (for example, by shifting the boundary along the row direction).

The signal processing unit 20 according to the embodiment described above generates the output intermediate signal Smid with the data conversion unit 23, performs sub-pixel rendering processing and signal control processing on the output intermediate signal Smid with the sub-pixel rendering processing unit 24 to generate an output signal, and performs reverse gamma conversion on the output signal with the reverse gamma conversion unit 25 to generate the output signal Sout. In a case of using this processing order, luminance deviation and a color shift from the input signal due to color conversion and sub-pixel rendering processing can be minimized. This processing order is a specific example of the order of signal processing performed by the signal processing unit 20, and is not limited thereto. The following describes a tenth modification and an eleventh modification of the embodiment of the present invention with reference to FIGS. 28 and 29.

Tenth Modification

Figure 28:
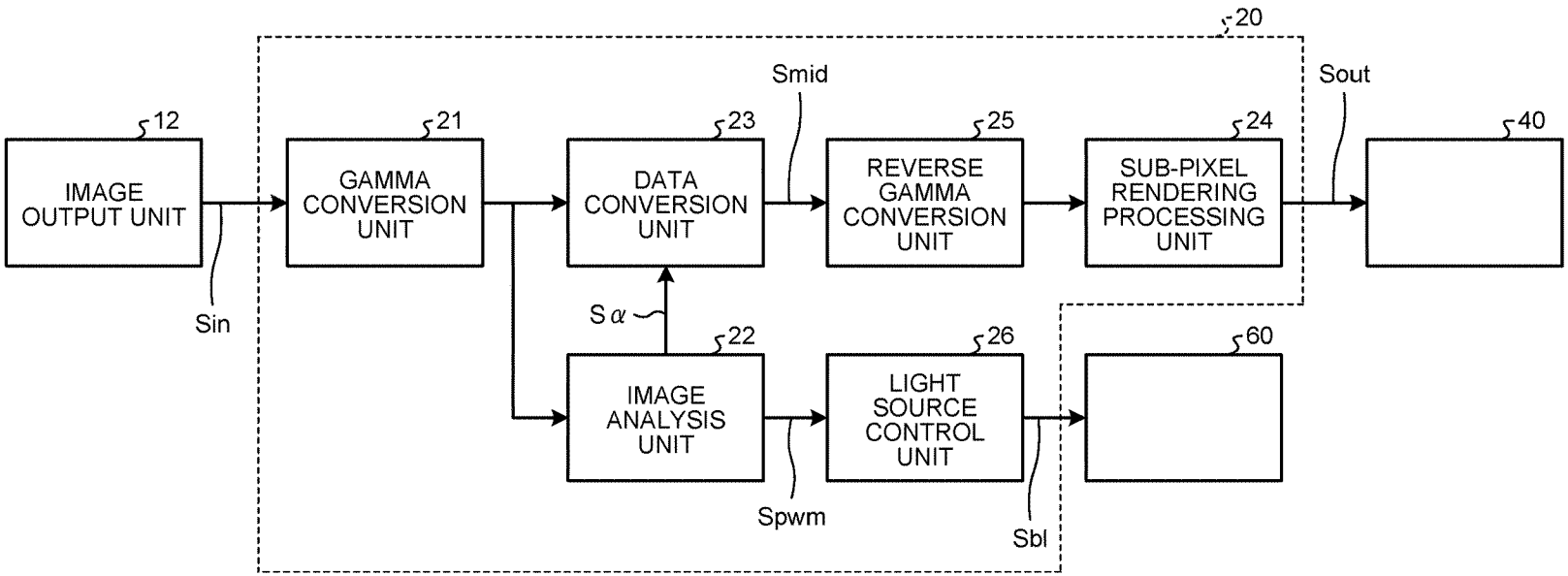
FIG. 28 is a block diagram for illustrating a signal processing unit according to a tenth modification.

FIG. 28 is a block diagram for illustrating the signal processing unit according to the tenth modification. As illustrated in FIG. 28, after the reverse gamma conversion unit 25 performs reverse gamma conversion on the output intermediate signal Smid from the data conversion unit 23, the sub-pixel rendering processing unit 24 may further perform sub-pixel rendering processing and signal control processing to generate the output signal Sout.

Eleventh Modification

Figure 29:
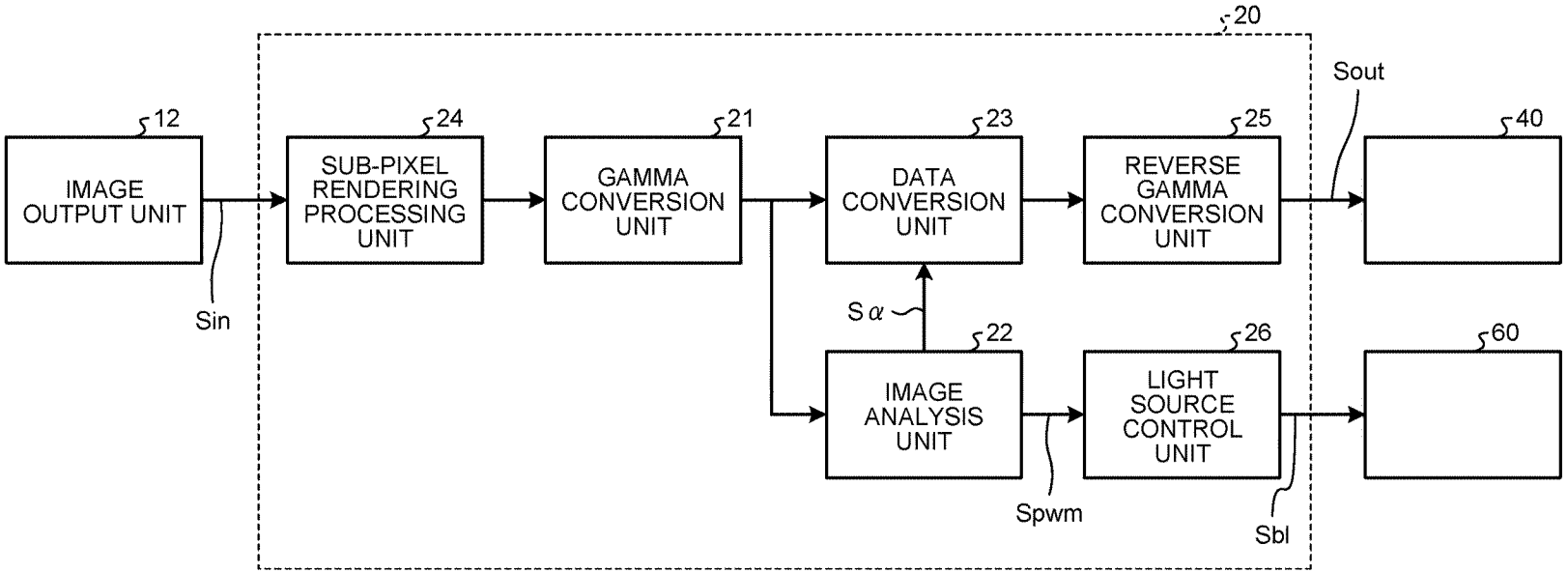
FIG. 29 is a block diagram for illustrating a signal processing unit according to an eleventh modification.

FIG. 29 is a block diagram for illustrating the signal processing unit according to the eleventh modification. As illustrated in FIG. 29, the sub-pixel rendering processing unit 24 may perform sub-pixel rendering processing on the input signal Sin from the image output unit 12 before gamma conversion processing. In this case, the sub-pixel rendering processing unit 24 performs sub-pixel rendering processing while neglecting presence of the sub-pixel 49 having high luminance (for example, white (W)). According to the eleventh modification, the input signal before sub-pixel rendering processing is not converted into RGBW data, so that a processing load of the sub-pixel rendering processing is smaller than that in a case of performing sub-pixel rendering processing after the input signal is converted into RGBW data by the data conversion unit 23 as described in the above embodiment. Accordingly, a circuit scale of the sub-pixel rendering processing unit 24 can be further reduced.

In the embodiment described above, the display device 10 is a transmissive color liquid crystal display device or a display device that lights a self-luminous body such as an organic light-emitting diode (OLED). Alternatively, the display device 10 may be a reflective color liquid crystal display device. The following describes a twelfth modification of the embodiment of the present invention with reference to FIGS. 30, 31, and 32.

Twelfth Modification

Figure 30:
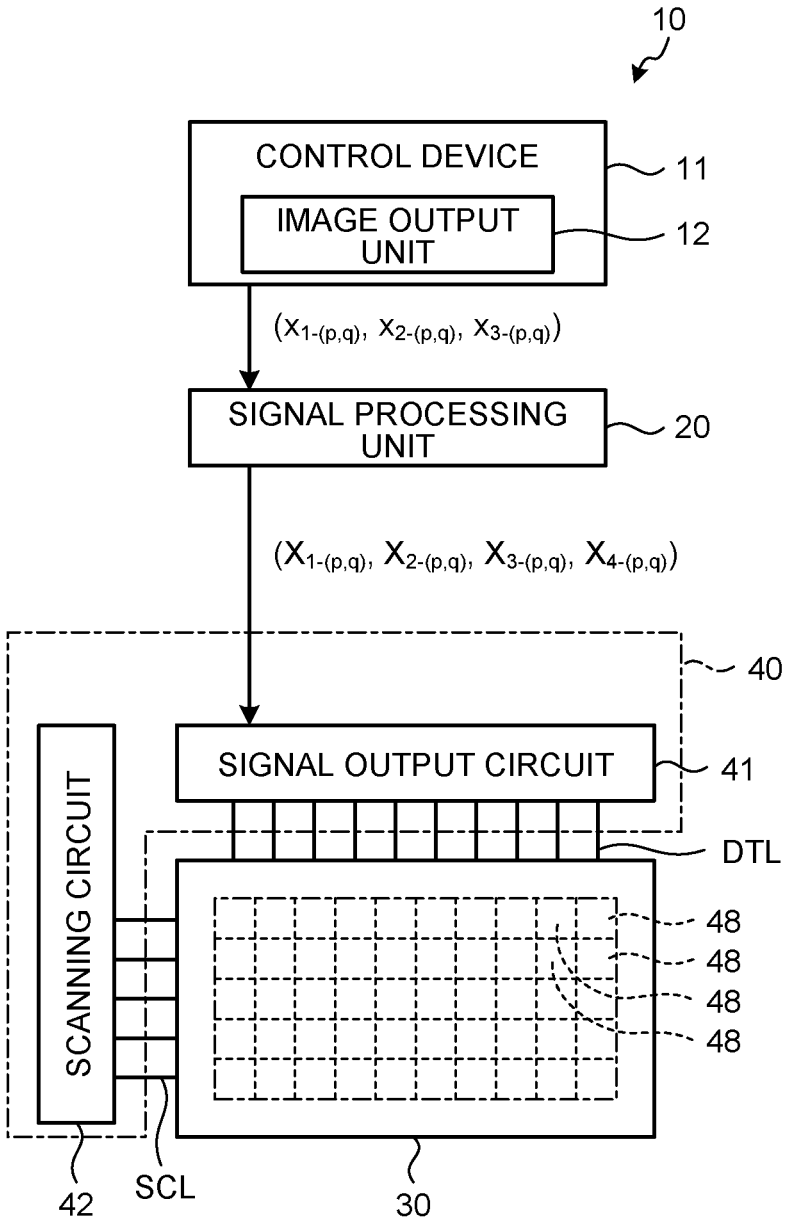
FIG. 30 is a block diagram illustrating a configuration example of a display device according to a twelfth modification.
Figure 31:
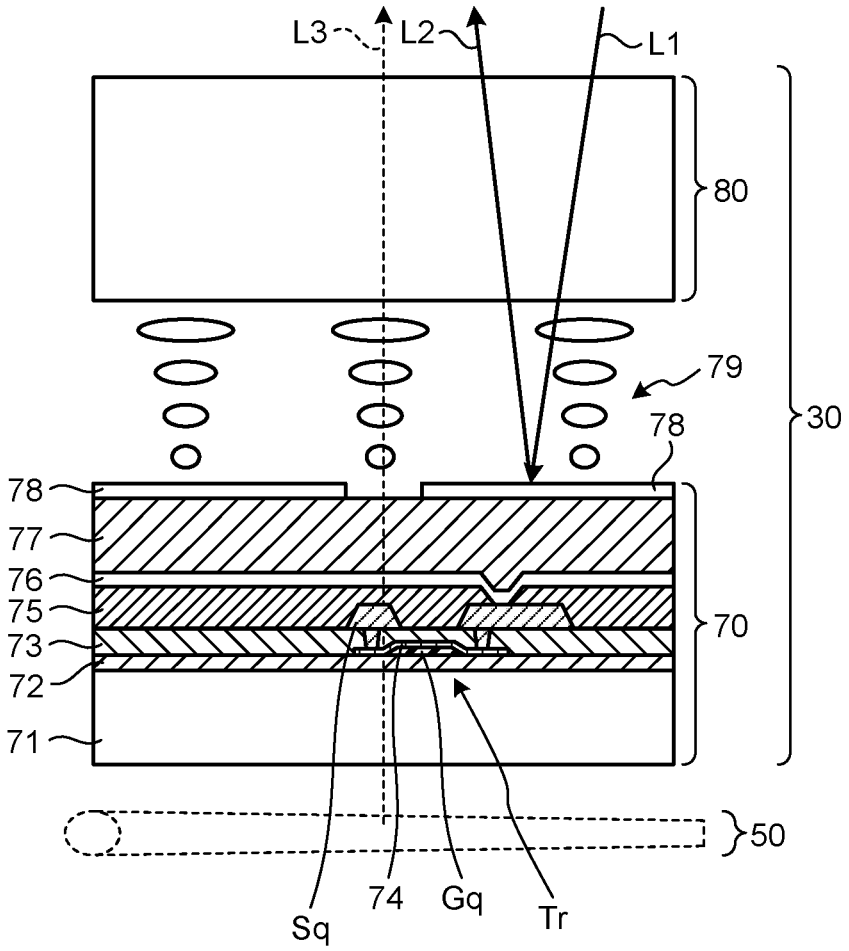
FIG. 31 is a schematic diagram for schematically illustrating a cross section of an image display panel according to the twelfth modification.
Figure 32:
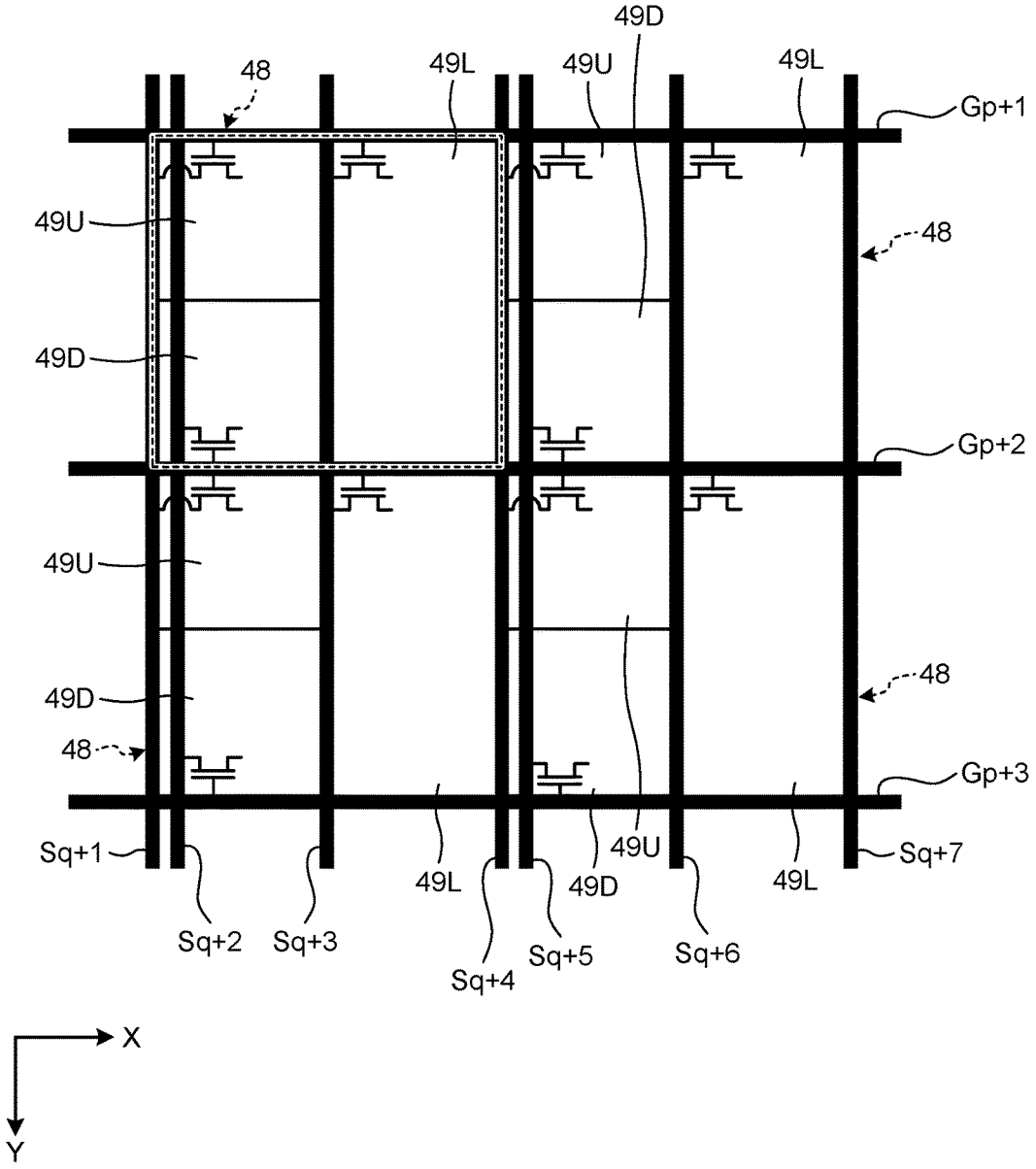
FIG. 32 is a diagram illustrating an array of pixels and sub-pixels in the image display panel according to the twelfth modification.

FIG. 30 is a block diagram illustrating a configuration example of the display device according to the twelfth modification. FIG. 31 is a schematic diagram for schematically illustrating a cross section of the image display panel according to the twelfth modification. FIG. 32 is a diagram illustrating the array of the pixels 48 and the sub-pixels 49 in the image display panel according to the twelfth modification. Detailed description of the same element as that described above will not be repeated.

As illustrated in FIG. 30, the display device 10 according to the twelfth modification includes the signal processing unit 20 that receives the input signal (RGB data) from the image output unit 12 of the control device 11 and performs predetermined data conversion processing on the input signal to output an output signal, the image display panel 30 that displays an image based on the output signal output from the signal processing unit 20, and the image-display-panel drive circuit 40 that controls driving of the image display panel (display unit) 30. The display device 10 according to the twelfth modification is a reflective display device, and can display an image on the image display panel 30 using light from a front light or environmental light from the outside. The front light is an example of a lighting device arranged on an observer side with respect to the display panel.

As illustrated in FIG. 31, the image display panel 30 includes a first substrate (pixel substrate) 70, a second substrate (counter substrate) 80 arranged to be opposed to a direction perpendicular to the surface of the first substrate 70, and a liquid crystal layer 79 interposed between the first substrate 70 and the second substrate 80. In the image display panel 30 according to the embodiment described above, the light source device 50 is arranged on a side of the first substrate (pixel substrate) 70 that is opposite to the liquid crystal layer 79 side of the first substrate 70. However, the image display panel according to the twelfth modification does not include the light source device 50.

The first substrate 70 is obtained by forming various circuits on a translucent substrate 71, and includes a plurality of first electrodes (pixel electrode) 78 arranged in a matrix and a second electrode (common electrodes) 76. The first electrodes 78 and the second electrode 79 are provided to the translucent substrate 71. As illustrated in FIG. 31, the first electrode 78 and the second electrode 76 are insulated from each other by an insulating layer 77, and face each other in a direction perpendicular to the surface of the translucent substrate 71. Each of the first electrode 78 and the second electrode 76 is a translucent electrode made of a translucent conductive material (translucent conductive oxide) such as indium tin oxide (ITO).

Assuming that the thin film transistor serving as the switching element of each sub-pixel 49 is a transistor Tr, in the first substrate 70, a semiconductor layer 74 on which the transistor Tr serving as the switching element of each sub-pixel 49 is formed and wiring such as the signal line DTL that supplies a pixel signal to each of the first electrodes 78 and the scanning line SCL that drives the transistor Tr are stacked on the translucent substrate 71 while being insulated from each other by insulating layers 72, 73, and 75.

The signal line DTL according to the twelfth modification hardly influences the first electrode 78 working as a reflective plate that reflects incident light L1 to be reflected light L2. Due to this, in the twelfth modification, it is not necessary to consider a case in which a signal line Sq ($0 \leq q \leq m$) shields transmitted light L3 from the light source device 50 unlike the transmissive color liquid crystal display device, so that the signal lines Sq+2 and Sq+5 are easily arranged as illustrated in FIG. 32 as compared with the transmissive color liquid crystal display device.

In FIG. 32, the signal lines Sq+2 and Sq+5 are arranged so as to overlap the two second sub-pixels 49U and 49D aligned along the column direction. The signal lines Sq+3 and Sq+6 are arranged at the positions where the signal lines Sq+2 and Sq+5 are arranged in the above embodiment (refer to FIG. 3). Thus, in the configuration illustrated in FIG. 32, the signal line DTL does not overlap the first sub-pixel 49L. The reflective liquid crystal display device like the display device 10 according to the twelfth modification includes a reflective layer (in this case, the pixel electrode 78) between the signal line and a display surface as illustrated in FIG. 31, so that the position of the signal line does not influence luminance of external light. Accordingly, the signal line can be arranged at any position and may be arranged at regular intervals to pass through the center of each sub-pixel.

Alternatively, in the display device 10 according to the twelfth modification, the first electrode 78 may be the common electrode, and the second electrode 76 may be the pixel electrode.

In the embodiment described above, the number of the sub-pixels 49 included in one pixel 48 is three. Alternatively, the number of the sub-pixels 49 may be four or more. When the number of the sub-pixels 49 is κ or more, the number of colors used for the display output is κ+1 or more. κ is a natural number equal to or larger than three. The following describes a thirteenth modification of the embodiment of the present invention with reference to FIG. 33.

Thirteenth Modification

Figure 33:
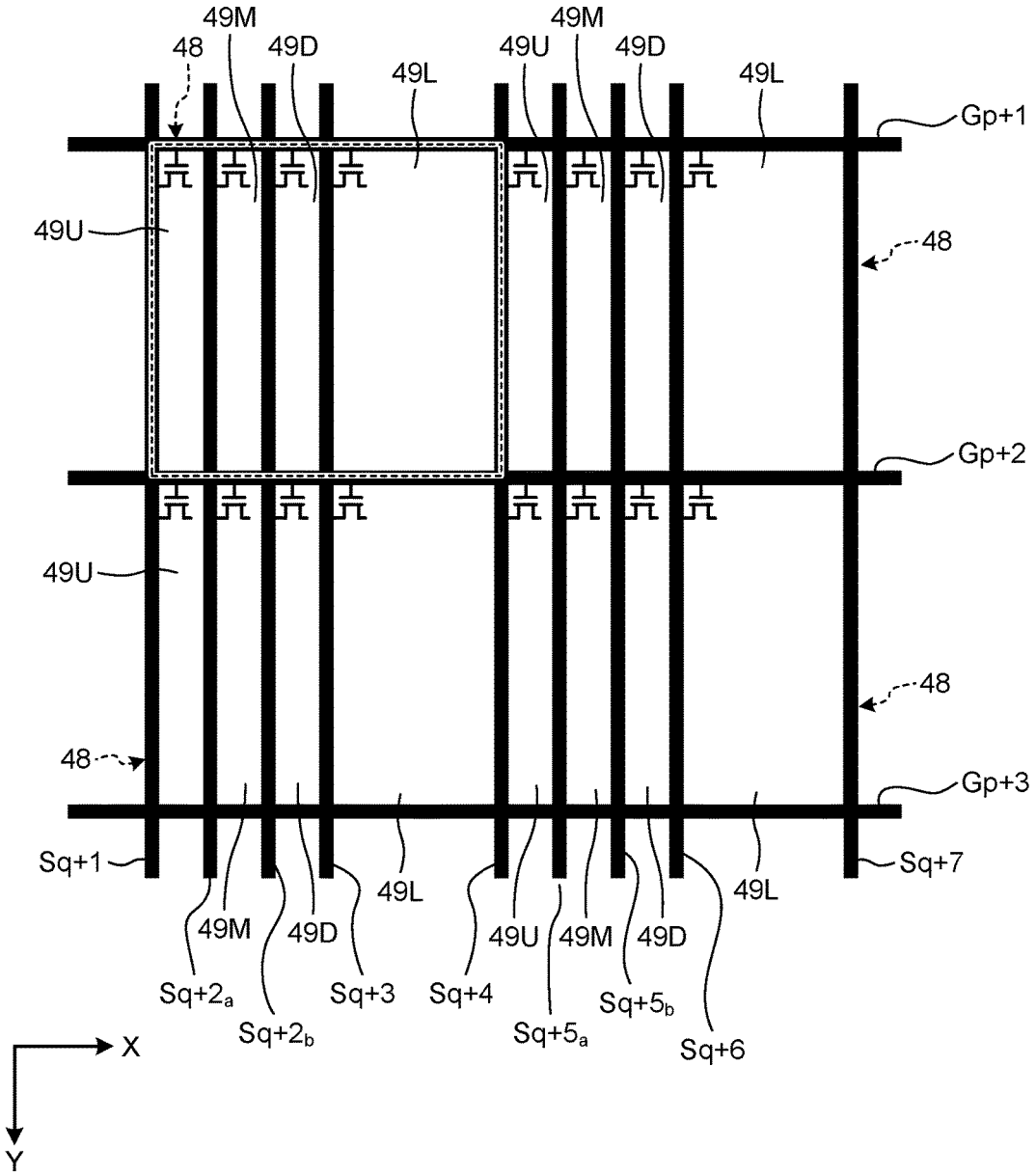
FIG. 33 is a diagram illustrating an array of pixels and sub-pixels in an image display panel according to a thirteenth modification.

FIG. 33 is a diagram illustrating the array of the pixels 48 and the sub-pixels 49 in the image display panel according to the thirteenth modification. FIG. 33 illustrates an example of the pixel 48 including the first sub-pixel 49L and three second sub-pixels 49U, 49M, and 49D. The first sub-pixel 49L in this modification has the same display region as that of the first sub-pixel 49L in the above embodiment. The second sub-pixels 49U, 49M, and 49D are arranged so as to divide a display region corresponding to the display region in which the two second sub-pixels 49U and 49D are arranged in the above embodiment into three equal parts with the signal lines $Sq+2_a$, $Sq+2_b$, $Sq+5_a$, and $Sq+5_b$. However, the number of the sub-pixels 49 and an area ratio between the first sub-pixel 49L and the second sub-pixels 49U, 49M, and 49D can be appropriately modified without deviating from a condition in which the first sub-pixel 49L is the largest sub-pixel 49. In the example illustrated in FIG. 33, the three second sub-pixels 49U, 49M, and 49D are arranged. Alternatively, the number of the second sub-pixels may be four or more. Also in the thirteenth modification, similarly to the embodiment described above, one of the second sub-pixels outputs the high luminance color (for example, white (W)).

The first to thirteenth modifications may be combined with each other so long as there is no contradiction. Specifically, part or all of the following modifications can be combined: one of the first modification and the second modification; one of the third modification, the fourth modification, and the fifth modification; one of the sixth modification and the seventh modification; the eighth modification; the ninth modification; one of the tenth modification and the eleventh modification; the twelfth modification; and the thirteenth modification.

The above description does not intend to limit the embodiment. The components according to the embodiment described above include a component that is easily conceivable by those skilled in the art, substantially the same component, and what is called an equivalent. In addition, the components can be variously omitted, replaced, and modified without departing from the gist of the embodiment described above.

What is claimed is:

1. A display device comprising a display unit that produces a display output corresponding to an input signal, the display unit combining the display output corresponding to each of four or more colors, the display unit including:

a plurality of pixels that are arranged in a row direction and a column direction, each of the pixels including three or more sub-pixels, the number of which is smaller than the number of colors; and a plurality of scanning lines each extending in the row direction, the scanning lines including a first scanning lines and a second scanning line, wherein each of the pixels includes:

as the sub-pixels, one first sub-pixel having largest display region among the sub-pixels and two or more second sub-pixels each having a display region smaller than that of the first sub-pixels, a first switch element in the first sub-pixel, a second switch element in one of the two or more second sub-pixels, and a third switch element in another of the two or more second sub-pixels, the first switch element and the second switch element are coupled to the first scanning line, the third switch element is coupled to the second scanning line, and one of the second sub-pixels outputs a high luminance color having highest luminance among the four or more colors.

2. The display device according to claim 1, wherein the sub-pixels included in one pixel output colors different from each other.

3. The display device according to claim 1, wherein combinations of colors of the sub-pixels included in each of adjacent pixels are different in at least one of the row direction and the column direction, and a color arrangement of the sub-pixels is periodically repeated in units of a predetermined number of pixels in the one direction.

4. The display device according to claim 1, wherein the two or more second sub-pixels are aligned in one of the row direction and the column direction, and the second sub-pixels and the first sub-pixel are aligned in the other one of the row direction and the column direction.

5. The display device according to claim 1 comprising a signal line coupled to each of the sub-pixels, wherein a signal line of the first sub-pixel is arranged at a position overlapping a display region of the first sub-pixel.

6. The display device according to claim 1, wherein a distance between two signal lines respectively coupled to the two second sub-pixels is different from a distance between a signal line coupled to the first sub-pixel and one of the signal lines coupled to the second sub-pixels.

7. The display device according to claim 1, wherein the sub-pixels are aligned in one of the row direction and the column direction.

8. The display device according to claim 1 comprising a signal processing unit that performs signal processing for determining outputs of the pixels based on the input signal, wherein in outputting a color that cannot be reproduced with sub-pixels included in one pixel, the signal processing unit produces an output using a sub-pixel that is included in another pixel and required for reproducing the color.

9. The display device according to claim 1 comprising a signal processing unit that performs signal processing for determining outputs of the pixels based on the input signal, wherein when the one pixel is assigned an input signal that requires a non-selected color that is a color other than colors of sub-pixels included in the one pixel, the signal processing unit produces an output using the other pixel including a sub-pixel including the non-selected color in an output of the one pixel.

10. The display device according to claim 1 comprising a signal processing unit that performs signal processing for determining outputs of the pixels based on the input signal, wherein when the one pixel is assigned an input signal that requires to output, with higher gradation, a specific color assigned to the second sub-pixel among the sub-pixels included in the one pixel, the signal processing unit produces an output using the other pixel including the sub-pixel including the specific color in an output of the one pixel.

11. A display device comprising a display unit including a color filter provided such that light of four or more predetermined number of colors is obtained, wherein the display unit includes:

a plurality of partial regions that are arranged in a row direction and a column direction, and a plurality of scanning lines each extending in the row direction, the scanning lines including a first scanning line and a second scanning line, the partial regions each include:

a first display region that is largest and two or more second display regions each of which is smaller than the first display region, a first switch element in the first display region, a second switch element in one of the two or more second display regions, a third switch element in another of the two or more second display regions, and color filters corresponding to three or more colors the number of which is smaller than the predetermined number are arranged in each partial region, the first switch element and the second switch element are coupled to the first scanning line, the third switch element is coupled to the second scanning line, and a color having the highest luminance among the predetermined number of colors is assigned to one of the second display regions.

12. The display device according to claim 11, wherein colors of light obtained from the first display region and the two or more second display regions configuring one partial region are different from each other.

13. The display device according to claim 11, wherein white has the highest luminance among the predetermined number of colors.

14. The display device according to claim 13, wherein a color filter corresponding to white is formed of a transparent resin layer.

15. The display device according to claim 13, wherein a resin layer as a color filter corresponding to white is not arranged.

16. The display device according to claim 11, wherein the two or more second display regions are aligned in one of the row direction and the column direction, and the second display regions and the first display region are aligned in the other one of the row direction and the column direction.

17. The display device according to claim 11 comprising a signal line coupled to each of the partial regions, wherein a signal line of the first display region is arranged at a position overlapping the first display region.

18. The display device according to claim 11, wherein a distance between two signal lines respectively coupled to the two second display regions is different from a distance between a signal line coupled to the first display region and one of the signal lines coupled to the second display regions.

19. The display device according to claim 11, wherein the first display region and the second display regions are aligned in one of the row direction and the column direction.

20. The display device according to claim 11 comprising a signal processing unit that performs signal processing for determining outputs based on an input signal, wherein in outputting a color that cannot be reproduced with one partial region, the signal processing unit produces an output using one of the first display region and the second display regions that are included in another partial region, the one display region being required for reproducing the color.

* * * * *